US011126115B2

(12) United States Patent
Sueoka

(10) Patent No.: US 11,126,115 B2
(45) Date of Patent: Sep. 21, 2021

(54) IMAGE FORMING APPARATUS THAT SETS A TRANSFER VOLTAGE

(71) Applicant: CANON KABUSHIKI KAISHA, Tokyo (JP)

(72) Inventor: Takenori Sueoka, Tsukuba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/798,986

(22) Filed: Feb. 24, 2020

(65) Prior Publication Data

US 2020/0285176 A1 Sep. 10, 2020

(30) Foreign Application Priority Data

Mar. 7, 2019 (JP) ..... JP2019-042075

(51) Int. Cl.
*G03G 15/16* (2006.01)
*G03G 15/00* (2006.01)

(52) U.S. Cl.
CPC ..... *G03G 15/1675* (2013.01); *G03G 15/5058* (2013.01)

(58) Field of Classification Search
USPC ..... 399/66
See application file for complete search history.

(56) References Cited

U.S. PATENT DOCUMENTS

| | | | | |
|---|---|---|---|---|
| 8,843,003 | B2 | 9/2014 | Nakao | |
| 10,180,641 | B2 | 1/2019 | Itagaki | |
| 2011/0268462 | A1* | 11/2011 | Honda | G03G 15/0178 399/49 |
| 2013/0039673 | A1* | 2/2013 | Nakao | G03G 15/6561 399/49 |
| 2019/0107797 | A1* | 4/2019 | Murayama | G03G 15/1665 |
| 2020/0166881 | A1* | 5/2020 | Omata | G03G 15/5062 |

FOREIGN PATENT DOCUMENTS

| | | | |
|---|---|---|---|
| JP | 2010145955 | A | 7/2010 |
| JP | 2013037185 | A | 2/2013 |
| JP | 2017072689 | A | 4/2017 |

* cited by examiner

*Primary Examiner* — Q Grainger
(74) *Attorney, Agent, or Firm* — Rossi, Kimms & McDowell LLP

(57) ABSTRACT

An image forming apparatus includes an image bearing member, a transfer member, a voltage source, a sensor configured to detect a current value or a voltage value, an image detecting portion, and a controller capable of executing an operation in a mode for setting a transfer voltage to be applied to the transfer member, on the basis of a result of detection of a test chart formed on a test recording material. The controller sets the transfer voltage on the basis of a first detection result acquired by the sensor under application of a voltage to the transfer member when the recording material is absent in the transfer portion and a second detection result acquired by the sensor under application of the test voltages to the transfer member when the test recording material is present in said transfer portion during the operation in the mode.

14 Claims, 11 Drawing Sheets

| | | AMBIENT WATER CONTENT(g/kg) | | | | |
|---|---|---|---|---|---|---|
| | | 0.9≥ | ··· | 8.9 | ··· | 21.5≤ |
| BASIS WEIGHT ($g/m^2$) | • | • | | • | | • |
| | • | • | | • | | • |
| | 81~100 | 1000V | ··· | 500V | ··· | 200V |
| | 101~125 | 1150V | ··· | 600V | ··· | 250V |
| | 126~150 | 1300V | ··· | 700V | ··· | 300V |
| | • | • | | • | | • |
| | • | • | | • | | • |

| PAPER CATEGORY | BASIS WEIGHT(g/m$^2$) | Vp(n) UPPER LIMIT |
|---|---|---|
| • | • | • |
| • | • | • |
| P.P. | 81~100 | 1200V |
| T.P.1 | 101~125 | 1350V |
| T.P.2 | 126~150 | 1500V |
| | • | • |
| | • | • |

IMAGE FORMING APPARATUS THAT SETS A TRANSFER VOLTAGE

FIELD OF THE INVENTION AND RELATED ART

The present invention relates to an image forming apparatus such as a copying machine, a printer or a facsimile machine using an electrophotographic type process or an electrostatic recording system.

In an image forming apparatus using an electrophotographic type process or the like, a toner image formed on an image bearing member such as a photosensitive member or an intermediary transfer member is transferred onto a recording material. The transfer of a toner image from an image bearing member to a recording material is often performed by applying a transfer voltage to a transfer member such as a transfer roller which contacts the image bearing member to form a transfer portion. Transfer voltage can be determined based on a transfer portion part voltage corresponding to the electrical resistance of the transfer portion detected during the pre-rotation process before image formation, and a recording material part voltage depending on the type of recording material set in advance. By this, an appropriate transfer voltage can be set according to the environmental fluctuations, the transfer member usage history, the recording material type, and the like.

However, there are various types and conditions of recording materials used in the image formation, and therefore, the preset recording material part voltage may be higher or lower than the appropriate transfer voltage. Under the circumstances, it is proposed that an adjustment mode is provided to adjust setting voltage (value) of the transfer voltage according to the recording material actually used in the image formation. Description will be further made using, as an example, an image forming apparatus of an intermediary transfer type including an intermediary transfer member.

Japanese Laid-open Patent Application No. 2013-37185 proposes an image forming apparatus operable in an adjustment mode for adjusting a setting voltage (value) of the secondary transfer voltage. In this adjustment mode, a chart with multiple patches (test images) formed on one recording material is outputted while switching the secondary transfer voltage for each patch. And, a density of each patch is detected, and depending on a detection result thereof, an optimum secondary transfer voltage condition is selected.

However, in the above-described conventional image forming apparatus, image defect such that the recording material is electrically discharged to during secondary transfer and a charge polarity of toner is reversed at an associated portion and the toner is not transferred onto the recording material and results in a white void in a dot shape (hereinafter also referred to as "white void") occurs in some cases.

The "white void" is liable to be visualized on a half-tone image, but as regards an image density, it is difficult to distinguish a difference between occurrence and non-occurrence of the "white void". For that reason, at the setting voltage (value) of the secondary transfer voltage selected from a detection result of the patch density as described above, an absolute value of the secondary transfer voltage is excessively large, so that the "white void" occurs in some instances.

SUMMARY OF THE INVENTION

Therefore, an object of the present invention is to provide an image forming apparatus capable of appropriately adjusting setting of a transfer voltage in a constitution in which the setting of the transfer voltage is adjusted by outputting a chart on which test images are formed.

According to an aspect of the present invention, there is provided an image forming apparatus comprising: an image bearing member configured to bear a toner image; a transfer member configured to transfer the toner image from the image bearing member onto a recording material at a transfer portion under application of a voltage; a voltage source configured to apply the voltage to the transfer member; a sensor configured to detect a current value or a voltage value when the voltage is applied from the voltage source to the transfer member; an image detecting portion configured to detect an image on the recording material; and a controller capable of executing an operation in a mode for setting a transfer voltage to be applied to the transfer member when the toner image is transferred to onto the recording material, on the basis of a result of detection such that test images are transferred onto a test recording material by applying a plurality of different transfer voltages from the voltage source to the transfer member to produce a test chart, and then the test chart is detected by the image detecting portion, wherein the controller sets the transfer voltage on the basis of a first detection result acquired by the sensor under application of a voltage to the transfer member when the recording material is absent in the transfer portion and a second detection result acquired by the sensor under application of the test voltages to the transfer member when the test recording material is present in the transfer portion during the operation in the mode.

Further features of the present invention will become apparent from the following description of exemplary embodiments with reference to the mounted drawings.

Figure 7:
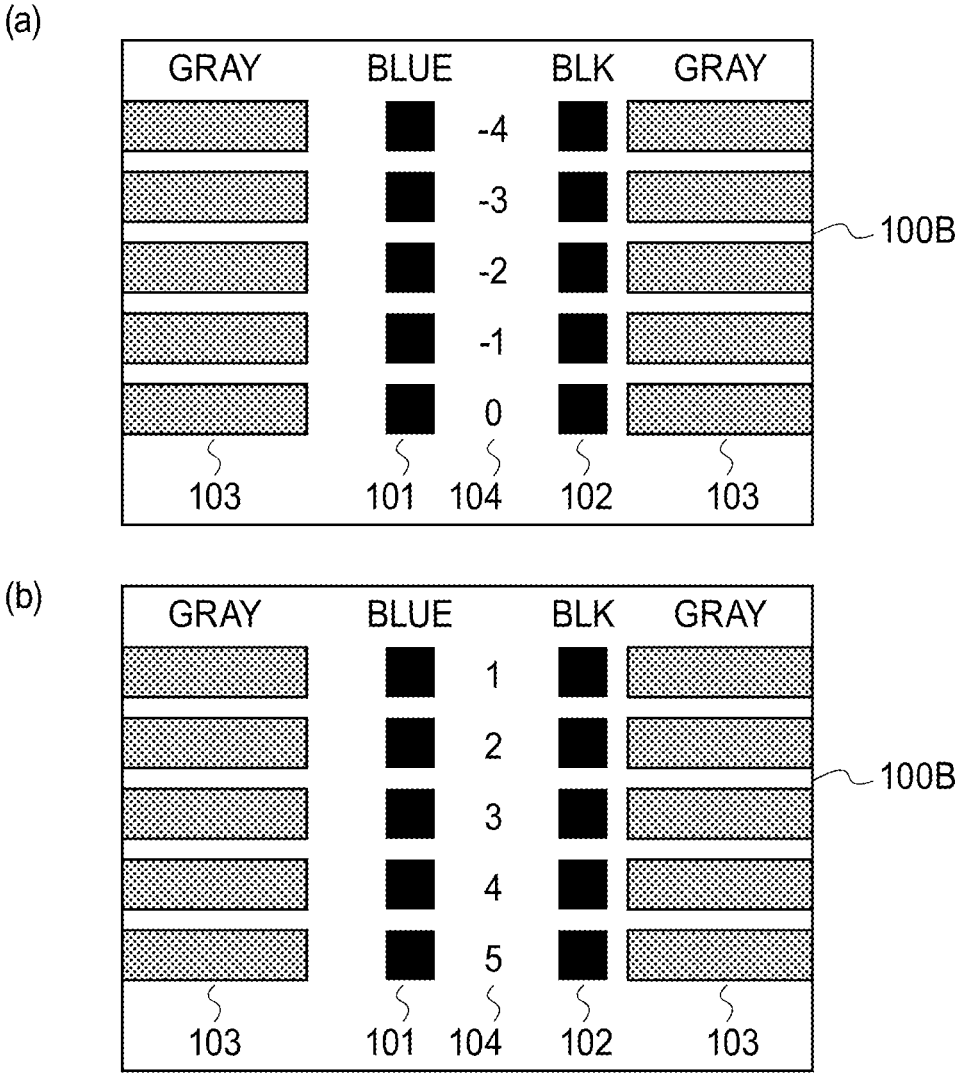

Parts (a) and (b) of FIG. 7 are schematic illustrations of chart image data outputted in the operation in the adjustment mode.

Figure 8:
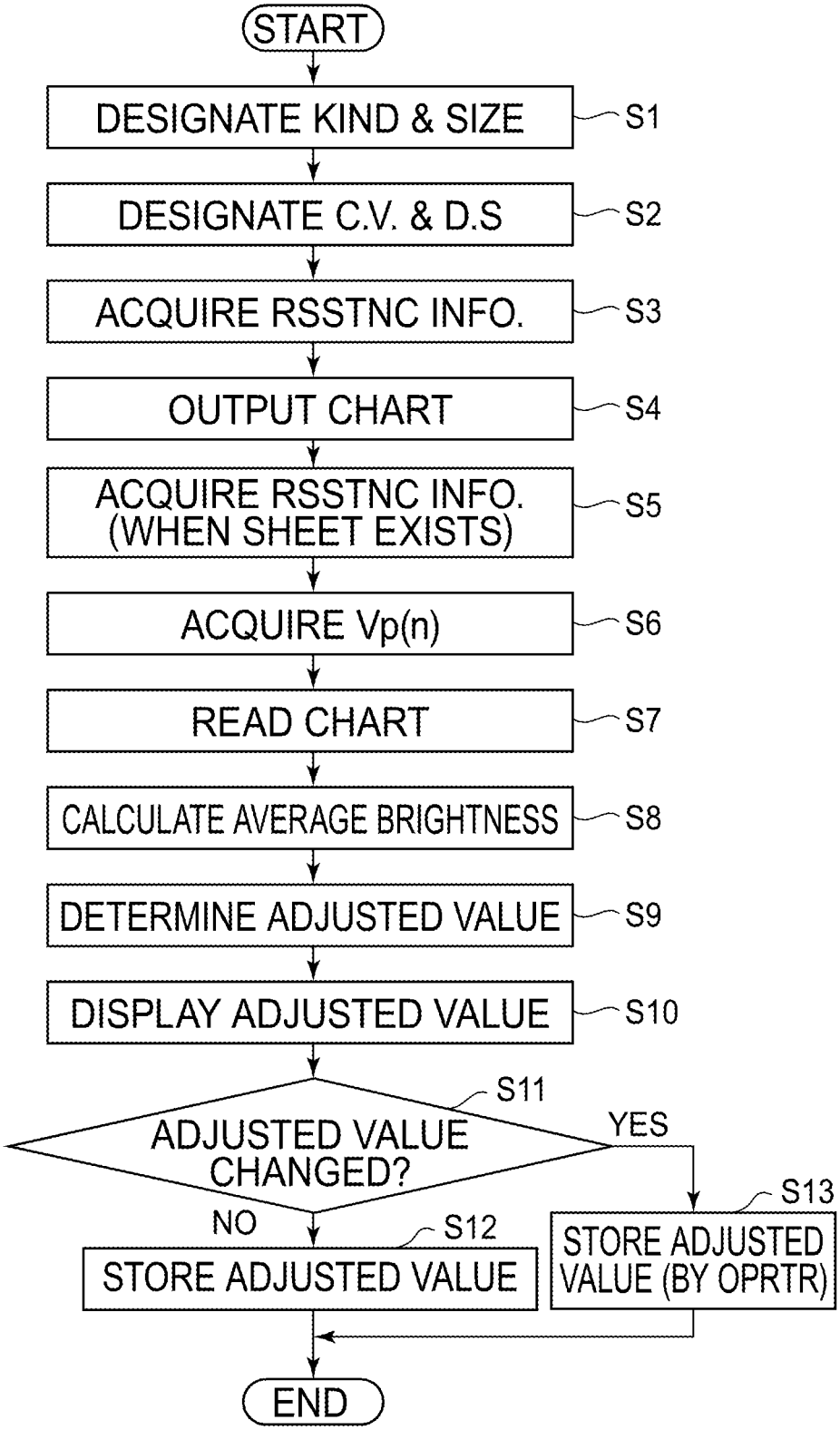

FIG. 8 is a flowchart showing an outline of a procedure of the operation in the adjustment mode.

Figure 9:
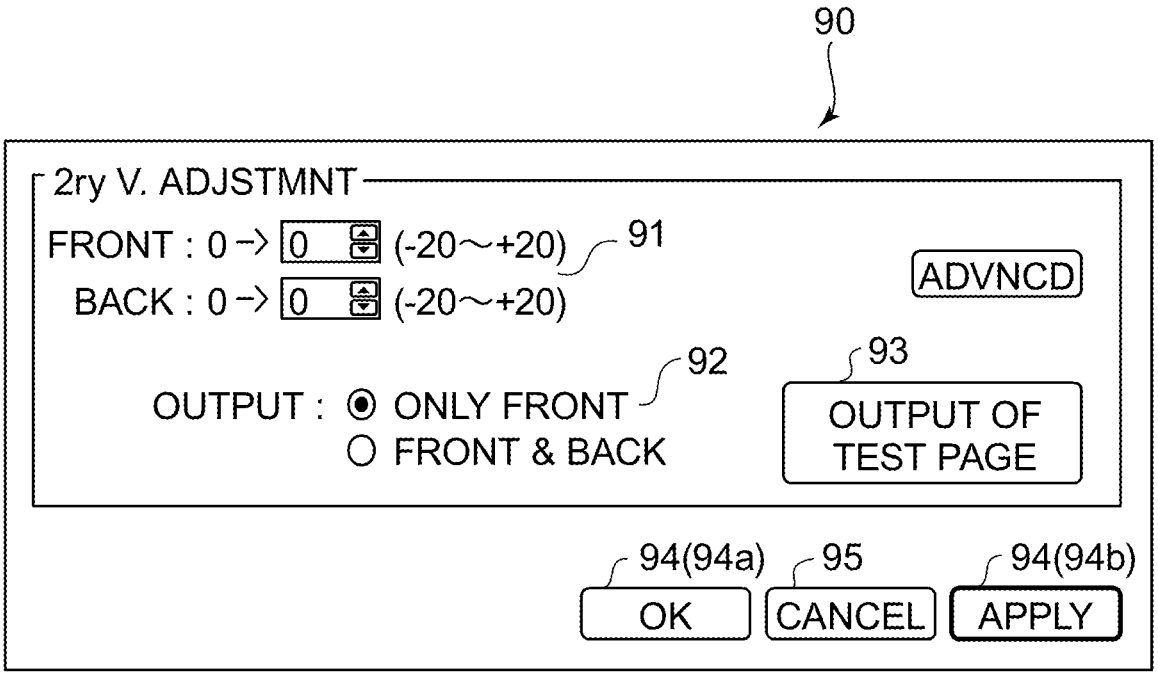

FIG. 9 is a schematic illustration of an adjustment mode setting screen.

Figure 10:
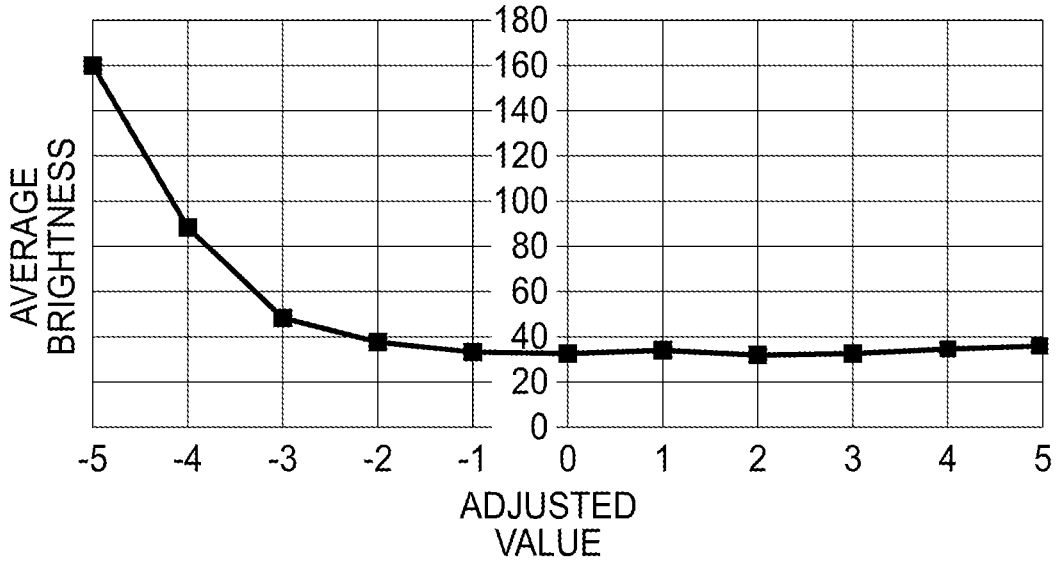

FIG. 10 is a graph showing an example of a relationship between an average of brightness of a patch and an adjusted value of the secondary transfer voltage.

Figures 11, 12:
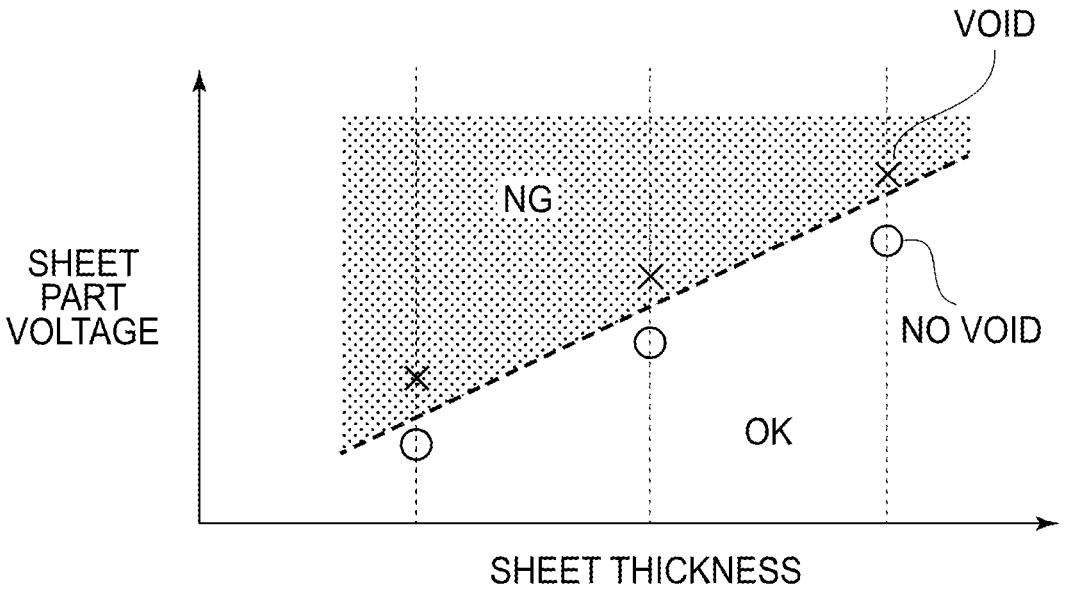

FIG. 11 is a graph showing an example of a relationship between a recording material part voltage and liability to occurrence of a "white volt".

FIG. 12 is a schematic illustration showing an example of table data of an upper limit of the recording material part voltage.

Figure 13:
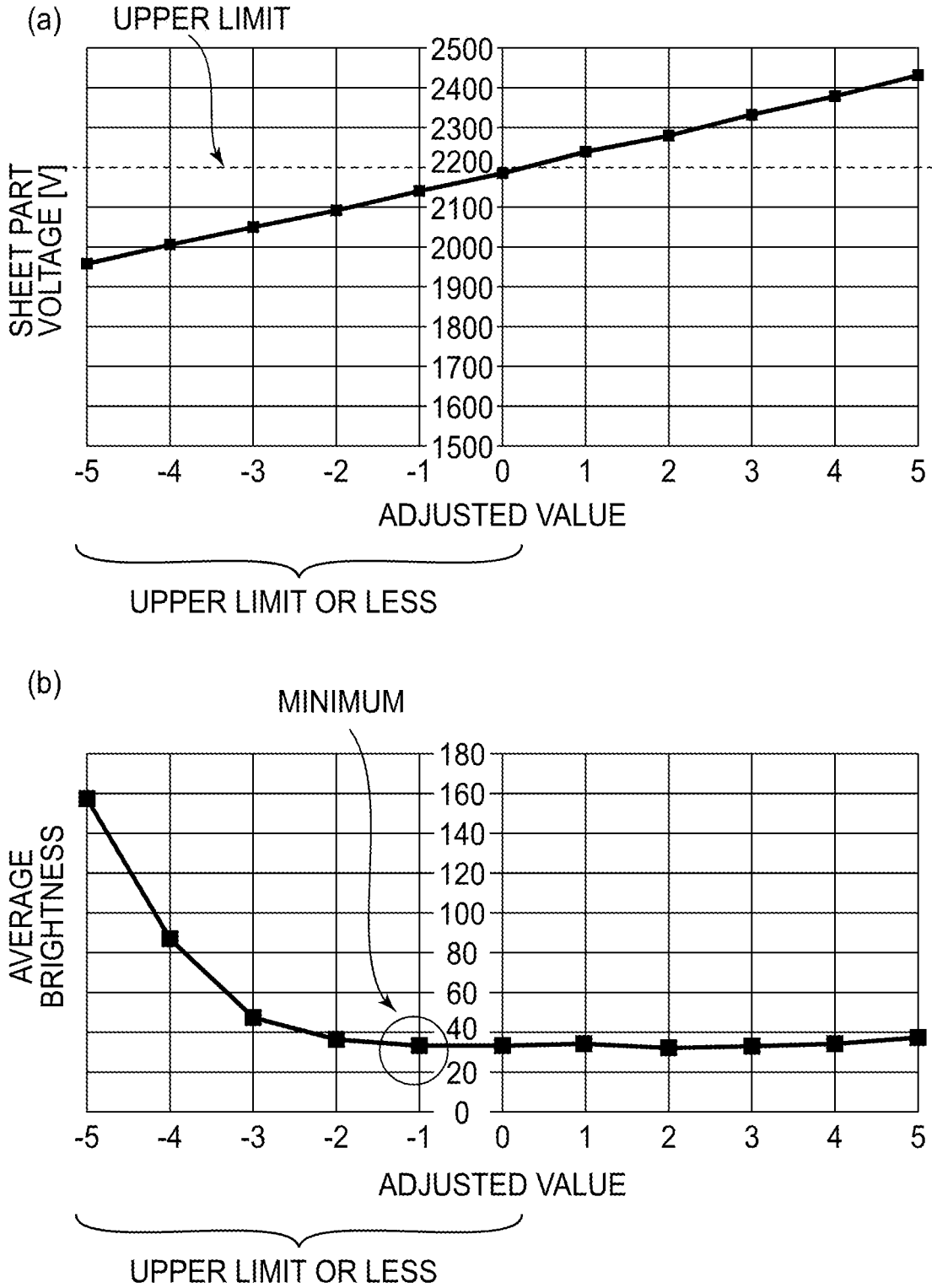

Parts (a) and (b) of FIG. 13 are graphs illustrating examples of a process of acquiring adjusted values.

Figure 14:
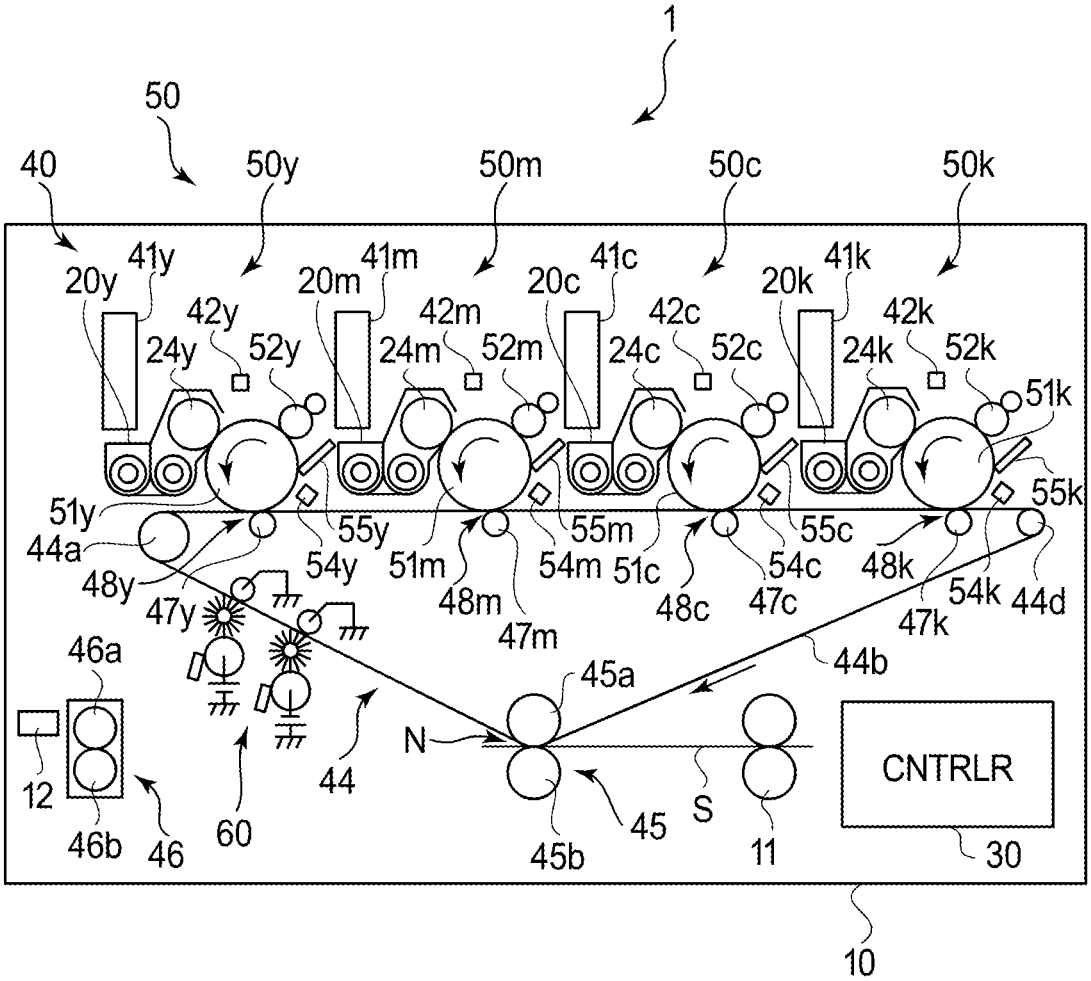

FIG. 14 is a schematic sectional view of an image forming apparatus in another embodiment.

DESCRIPTION OF EMBODIMENTS

In the following, the image forming apparatus according to the present invention will be described in more detail with reference to the drawings.

Embodiment 1

1. Structure and Operation of Image Forming Apparatus

Figure 1:
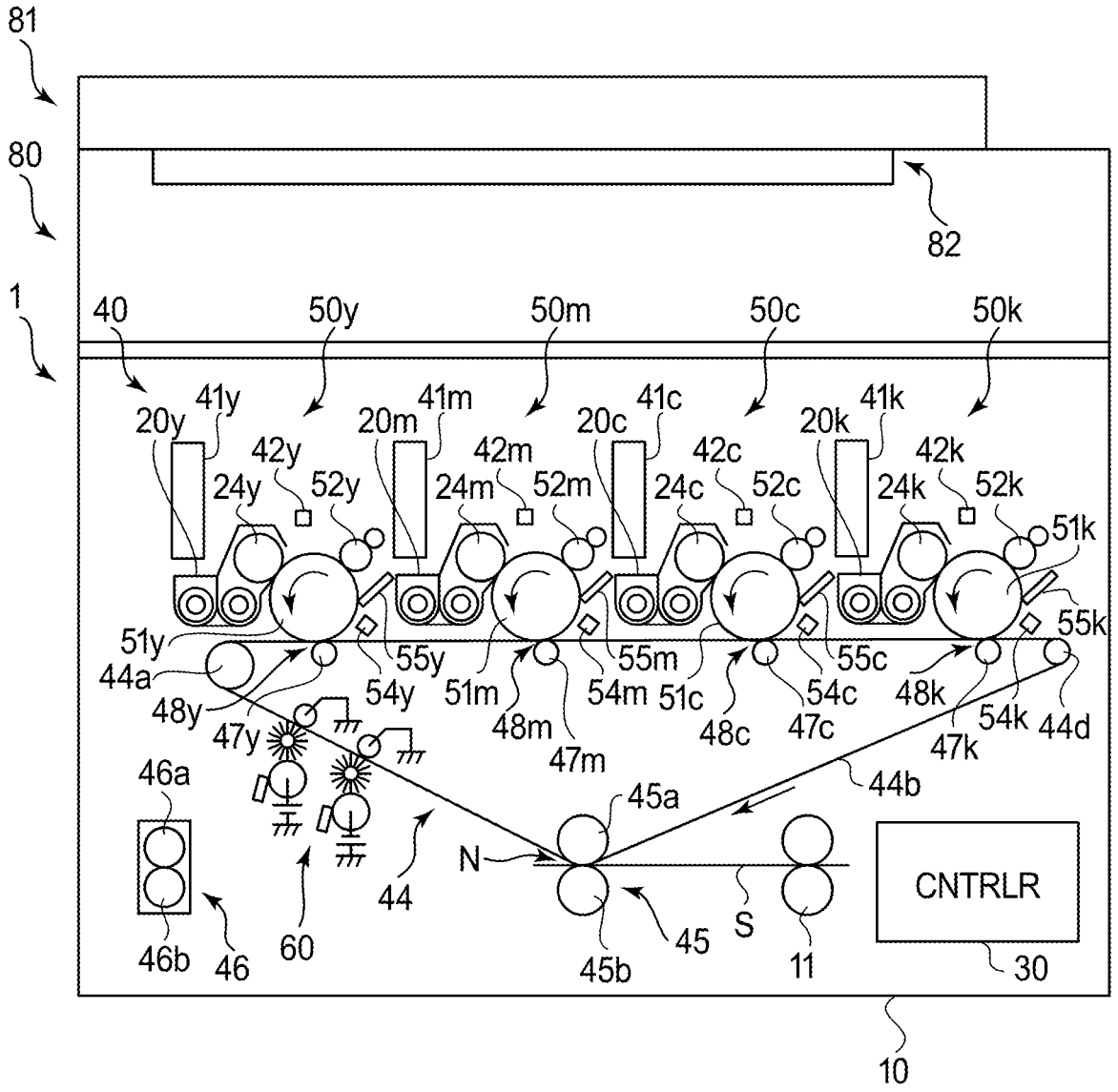
FIG. 1 is a schematic sectional view of an image forming apparatus.

FIG. 1 is a schematic cross-sectional view of an image forming apparatus 1 of this embodiment. The image forming apparatus 1 of this embodiment is a tandem type full-color printer capable of forming a full-color image by using an electrophotographic type and employing an intermediary transfer type. However, the image forming apparatus of the present invention is to not limited to a tandem type image forming apparatus, and may be an image forming apparatus of another type. In addition, the image forming apparatus is not limited to an image forming apparatus capable of forming the full-color image, and may be an image forming apparatus capable of forming only a monochromatic image. Further, the image forming apparatus may also be various-purpose image forming apparatuses such as printers, various printing machines, copying machines, facsimile machines and multi-function machines.

Figure 2:
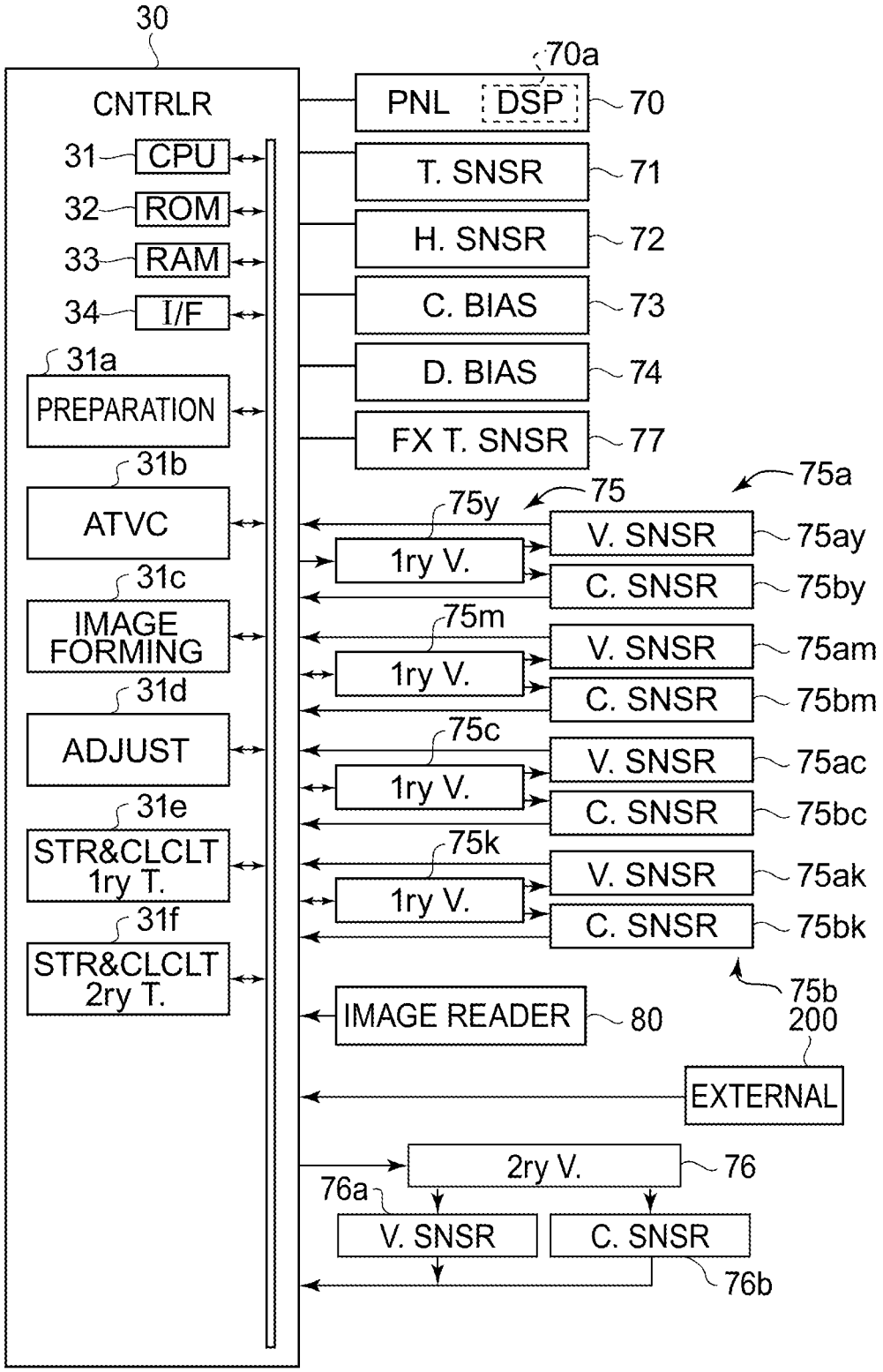
FIG. 2 is a block illustration showing a schematic structure of a control system of the image forming apparatus.

As shown in FIG. 1, the image forming apparatus 1 comprises an apparatus main assembly 10, a feeding portion (not shown), an image forming portion 40, a discharge portion (not shown), a controller 30, an operation portion 70 (FIG. 2). Inside the apparatus main assembly 10, a temperature sensor 71 (FIG. 2) capable of detecting the temperature inside the apparatus and a humidity sensor 72 (FIG. 2) capable of detecting the humidity inside the apparatus are provided. The image forming apparatus 1 can form 4—color full-color image on recording material (sheet, transfer material) S, in accordance with image signals supplied from an image reading portion 80 as a reading means for reading an image on the sheet and an external device 200 (FIG. 2). As the external device 200, it is possible to cite a host device, such as a personal computer, or a digital camera or a smartphone. Here, the recording material S is the material on which a toner image is formed, and specific examples thereof include plain paper, synthetic resin sheets which are substitutes for plain paper, cardboard, and overhead projector sheets.

The image forming portion 40 can form the image on the recording material S fed from the feeding portion on the basis of the image information. The image forming portion 40 comprises an image forming units 50*y*, 50*m*, 50*c*, 50*k*, toner bottles 41*y*, 41*m*, 41*c*, 41*k*, exposure devices 42*y*, 42*m*, 42*c*, 42*k*, an intermediary transfer unit 44, and a secondary transfer device 45, and a fixing portion 46. The image forming units 50*y*, 50*m*, 50*c*, and 50*k* form yellow (y), magenta (m), cyan (c), and black (k) images, respectively. Elements having the same or corresponding functions or structures provided for these four image forming units 50*y*, 50*m*, 50*c*, and 50*k* may be referred to, with y, m, c and k omitted, in the case that the description applies to all colors. Here, the image forming apparatus 1 can also form a single-color or multi-color image by using an image forming unit 50 for a desired single color or some of four colors, such as a monochromatic black image.

The image forming unit 50 includes the following means. First, a photosensitive drum 51 which is a drum-type (cylindrical) photosensitive member (electrophotographic photosensitive member) as a first image bearing member is provided. In addition, a charging roller 52, which is a roller-type charging member, is used as charging means. In addition, a developing device 20 is provided as developing means. In addition, a pre-exposure device 54 is provided as a charge eliminating portion. In addition, a cleaning blade 55 which is a cleaning member as a photosensitive member cleaning member is provided. The image forming unit 50 forms a toner image on the intermediary transfer belt 44*b* which will be described hereinafter. The image forming unit 50 is unitized as a process cartridge and can be mounted to and dismounted from the apparatus main assembly 10.

The photosensitive drum 51 is movable (rotatable) carrying an electrostatic image (electrostatic latent image) or a toner image. In this embodiment, the photosensitive drum 51 is a negative charging property organic photosensitive member (OPC) having an outer diameter of 30 mm. The photosensitive drum 51 has an aluminum cylinder as a base material and a surface layer formed on the surface of the base material. In this embodiment, the surface layer comprises three layers of an undercoat layer, a photocharge generation layer, and a charge transportation layer, which are applied and laminated on the substrate in the order named. When the image forming operation is started, the photosensitive drum 51 is driven to rotate in a direction indicated by an arrow (counterclockwise) in the Figure at a predetermined process speed (circumferential speed) by a motor (not shown) as a driving means.

The surface of the rotating photosensitive drum 51 is uniformly charged by the charging roller 52. In this embodiment, the charging roller 52 is a rubber roller which contacts the surface of the photosensitive drum 51 and is rotated by the rotation of the photosensitive drum 51. The charging roller 52 is connected with a charging bias power source 73 (FIG. 2). The charging bias power source 73 applies a charging bias (charging voltage) to the charging roller 52 during the charging process.

The surface of the charged photosensitive drum 51 is scanned and exposed by the exposure device 42 in accordance with the image information, so that an electrostatic image is formed on the photosensitive drum 51. The exposure device 42 includes a laser scanner in this embodiment. The exposure device 42 emits laser beam in accordance with the separated color image information outputted from the controller 30, and scans and exposes the surface (outer peripheral surface) of the photosensitive drum 51.

The electrostatic image formed on the photosensitive drum 51 is developed (visualized) by supplying the developer toner thereto by the developing device 20, so that a toner image is formed on the photosensitive drum 51. In this embodiment, the developing device 20 contains a two-component developer (also simply referred to as "developer") comprising non-magnetic toner particles (toner) and magnetic carrier particles (carrier). The toner is supplied from the toner bottle 41 to the developing device 20. The developing device 20 includes a developing sleeve 24. The developing sleeve 24 is made of a nonmagnetic material such as aluminum or nonmagnetic stainless steel (aluminum in this embodiment). Inside the developing sleeve 24, a magnet roller, which is a roller-shaped magnet, is fixed and arranged so as not to rotate relative to the main body (developing container) of the developing device 20. The developing sleeve 24 carries a developer and conveys it to a developing zone facing the photosensitive drum 51. A developing bias power source 74 (FIG. 2) is connected to the developing sleeve 24. The developing bias power source 74 applies a developing bias (developing voltage) to the developing sleeve 24 during the developing process operation. In this embodiment, the normal charging polarity of the toner, which is the charging polarity of the toner during development, is negative.

An intermediary transfer unit 44 is arranged so as to face the four photosensitive drums 51*y*, 51*m*, 51*c*, 51*k*. The intermediary transfer unit 44 includes an intermediary transfer belt 44*b*, constituted by an endless belt, as a second image bearing member. The intermediary transfer belt 44*b* is wound around a plurality of rollers such as a driving roller 44*a*, a driven roller 44*d*, primary transfer rollers 47*y*, 47*m*, 47*c*, 47*k*, and an inner secondary transfer roller 45*a*. The intermediary transfer belt 44*b* is movable (rotatable) carrying the toner image. The driving roller 44*a* is rotationally driven by a motor (not shown) as driving means, and rotates (circulates) the intermediary transfer belt 44*b*. The driven roller 44*d* is a tension roller which controls the tension of the intermediary transfer belt 44*b* to be constant. The driven roller 44*d* is subjected to a force which pushes the intermediary transfer belt 44*b* toward the outer peripheral surface by the urging force of a spring (not shown) as a biasing means, and by this force, a tension of about 2 to 5 kg is applied in the feeding direction of the intermediary transfer belt 44*b*. The inner secondary transfer roller 45*a* constitutes the secondary transfer device 45 as will be described hereinafter. The driving force is transmitted to the intermediary transfer belt 44*b* by the driving roller 44*a*, and the intermediary transfer belt 44*b* is rotationally driven in the arrow direction (clockwise) in the drawing at a predetermined peripheral speed corresponding to the peripheral speed of the photosensitive drum 51. In addition, the intermediary transfer unit 44 is provided with a belt cleaning device 60 as intermediary transfer member cleaning means.

The primary transfer rollers 47*y*, 47*m*, 47*c*, 47*k*, which are roller-type primary transfer members as primary transfer means, are arranged to face the photosensitive drums 51*y*, 51*m*, 51*c*, 51*k*, respectively. The primary transfer roller 47 holds the intermediary transfer belt 44*b* between the photosensitive drum 51 and the primary transfer roller 47. By this, the intermediary transfer belt 44*b* contacts the photosensitive drum 51 to form a primary transfer portion (primary transfer nip portion) 48 with the photosensitive drum 51.

The toner image formed on the photosensitive drum 51 is primarily transferred onto the intermediary transfer belt 44*b* by the action of the primary transfer roller 47 in the primary transfer portion 48. That is, in this embodiment, by applying a positive primary transfer voltage to the primary transfer roller 47, a negative toner image on the photosensitive drum 51 is primarily transferred onto the intermediary transfer belt 44*b*. For example, when forming a full-color image, the yellow, magenta, cyan, and black toner images formed on the photosensitive drums 51*y*, 51*m*, 51*c*, and 51*k* are transferred so as to be sequentially superimposed on the intermediary transfer belt 44*b*. A primary transfer power source 75 (FIG. 2) is connected to the primary transfer roller 47. The primary transfer power supply 75 applies a DC voltage having a polarity opposite to the normal charging polarity of the toner (positive polarity in this embodiment) as a primary transfer bias (primary transfer voltage) to the primary transfer roller 47 during the primary transfer process operation. The primary transfer power supply 75 is connected to a voltage detection sensor 75*a* which detects the output voltage and a current detection sensor 75*b* which detects the output current (FIG. 2). In this embodiment, the primary transfer power sources 75*y*, 75*m*, 75*c*, and 75*k* are provided for the primary transfer rollers 47*y*, 47*m*, 47*c*, and 47*k*, respectively, and the primary transfer voltages applied to the primary transfer rollers 47*y*, 47*m*, 47*c* and 47*k* can be individually controlled.

In this embodiment, the primary transfer roller 47 has an elastic layer of ion conductive foam rubber (NBR rubber) and a cored bar. The outer diameter of the primary transfer roller 47 is, for example, 15 to 20 mm. In addition, as the primary transfer roller 47, a roller having an electric resistance value of $1\times10^5$ to $1\times10^8\Omega$ (N/N (23° C., 50% RH) condition, 2 kV applied) can be preferably used.

In this embodiment, the intermediary transfer belt 44*b* is an endless belt having a three-layer structure including a base layer, an elastic layer, and a surface layer in the order named from the inner peripheral surface side. As the resin material constituting the base layer, a resin such as polyimide or polycarbonate, or a material containing an appropriate amount of carbon black as an antistatic agent in various rubbers can be suitably used. The thickness of the base layer is, for example, 0.05 to 0.15 [mm]. As the elastic material constituting the elastic layer, a material containing an appropriate amount of an ionic conductive agent in various rubbers such as urethane rubber and silicone rubber can be suitably used. The thickness of the elastic layer is 0.1 to 0.500 [mm], for example. As a material constituting the surface layer, a resin such as a fluororesin can be suitably used. The surface layer has small adhesive force of the toner to the surface of the intermediary transfer belt 44*b* and makes it easier to transfer the toner onto the recording material S at the secondary transfer portion N. The thickness of the surface layer is, for example, 0.0002 to 0.020 [mm]. In this embodiment, for the surface layer, one kind of resin material such as polyurethane, polyester, epoxy resin, or two or more kinds of elastic materials such as elastic material rubber, elastomer, butyl rubber, for example, is used as a base material. And, as a material for reducing the surface energy and improving the lubricity of this base material, powder or particles such as fluororesin, for example, with one kind or two kinds or different particle diameters are dispersed, so that a surface layer is formed. In this embodiment, the intermediary transfer belt 44*b* has a volume resistivity of $5\times10^8$ to $1\times10^{14}$ [Ω, cm] (23° C., 50% RH) and a hardness of MD1 hardness of 60 to 85° (23° C., 50% RH). In this embodiment, the static friction coefficient of the intermediary transfer belt 44*b* is 0.15 to 0.6 (23° C., 50% RH, type 94*i* manufactured by HEIDON). In this embodiment, a three-layer structure was employed, but a single-layer structure of a material corresponding to the material of the base layer may also be employed.

On the outer peripheral surface side of the intermediary transfer belt 44*b*, an outer secondary transfer roller 45*b* which constitutes the secondary transfer device 45 in cooperation with the inner secondary transfer roller 45*a* is disposed. The outer secondary transfer roller 45*b* contacts the intermediary transfer belt 44*b* contacting the inner secondary transfer roller 45*a* and forms a secondary transfer portion (secondary transfer nip portion) N between the intermediary transfer belt 44*b*. The toner image formed on the intermediary transfer belt 44*b* is secondarily transferred onto the recording material S by the action of the secondary transfer device 45 in the secondary transfer portion N. In this embodiment, a positive secondary transfer voltage is applied to the outer secondary transfer roller 45*b* so that the negative toner image on the intermediary transfer belt 44*b* is secondarily transferred onto the recording material S which is nipped and fed between the intermediary transfer belt 44*b* and the outer secondary transfer roller 45*b*. The recording material S is fed from a feeding portion (not shown) in parallel with the above-described toner image forming operation, and the toner image on the intermediary transfer belt 44*b* is fed by a registration roller pair 11 provided in the feeding path at the timing adjusted. The sheet is then fed to the secondary transfer portion N.

As described above, the secondary transfer device 45 includes an inner secondary transfer roller 45*a* as a counter member, and an outer secondary transfer roller 45*b* which is a roller-type secondary transfer member as a secondary transfer portion. The inner secondary transfer roller 45*a* is disposed opposite to the outer secondary transfer roller 45*b* with the intermediary transfer belt 44*b* interposed therebetween. To the outer secondary transfer roller 45*b*, a secondary transfer power supply 76 as applying means (FIG. 2) is connected. During the secondary transfer process, the secondary transfer power source 76 applies a DC voltage having a polarity opposite to the normal charging polarity of the toner (positive in this embodiment) to the outer secondary transfer roller 45*b* as secondary transfer bias (secondary transfer voltage). The secondary transfer power source 76 is connected to a voltage detection sensor 76*a* for detecting the output voltage and a current detection sensor 76*b* for detecting the output current (FIG. 2). The core of the inner secondary transfer roller 45*a* is connected to the ground potential. And, when the recording material S is supplied to the secondary transfer portion N, a secondary transfer voltage with constant-voltage-control having a polarity opposite to the normal charging polarity of the toner is applied to the outer secondary transfer roller 45*b*. In this embodiment, a secondary transfer voltage of 1 to 7 kV is applied, a current of 40 to 120 μA, for example is applied, and the toner image on the intermediary transfer belt 44*b* is secondarily transferred onto the recording material S. Here, in this embodiment, an alternative connection is that the inner secondary transfer roller 45*a* is connected to the ground potential, and a voltage is applied from the secondary transfer power source 76 to the outer secondary transfer roller 45*b*. On the other hand, a voltage from the secondary transfer power source 76 is applied to the inner secondary transfer roller 45*a* as a secondary transfer member, and the outer secondary transfer roller 45*b* as an opposing member is connected to the ground potential. In such a case, a DC voltage having the same polarity as the normal charging polarity of the toner is applied to the inner secondary transfer roller 45*a*.

In this embodiment, the outer secondary transfer roller 45*b* has an elastic layer of ion conductive foam rubber (NBR rubber) and a core metal. The outer diameter of the outer secondary transfer roller 45*b* is, for example, 20 to 25 mm. In addition, as the outer secondary transfer roller 45*b*, a roller having an electric resistance value of $1\times10^5$ to $1\times10^8\Omega$ (measured at N/N (23° C., 50% RH), 2 kV applied) can be preferably used.

The recording material S onto which the toner image has been transferred is fed to a fixing portion 46 as a fixing means. The fixing portion 46 includes a fixing roller 46*a* and a pressure roller 46*b*. The fixing roller 46*a* includes therein a heater as a heating means. The recording material S carrying the unfixed toner image is heated and pressed by being sandwiched and fed between the fixing roller 46*a* and the pressure roller 46*b*. By this, the toner image is fixed (melted and fixed) on the recording material S. Here, the temperature of the fixing roller 46*a* (fixing temperature) is detected by a fixing temperature sensor 77 (FIG. 2).

The recording material S on which the toner image is fixed is fed through a discharge path in a discharge portion (not shown), is discharged through a discharge port, and then stacked on a discharge tray provided outside the apparatus main assembly 10. In addition, between the fixing portion 46 and the discharge opening of the discharge portion, a reverse feeding path (not shown) for turning over the recording material S on which the toner image is fixed on the first surface and for supplying the recording material S to the secondary transfer portion N again. Z). The recording material S re-supplied to the secondary transfer portion N by the operation of the reverse feeding path is discharged onto the outside of the apparatus main assembly 10 after the toner image is transferred and fixed on the second side. As described above, the image forming apparatus 1 of this embodiment is capable of executing automatic double-sided printing which forms images on both sides of a single recording material S.

The surface of the photosensitive drum 51 after the primary transfer is electrically discharged by the pre-exposure device 54. In addition, the toner remaining on the photosensitive drum 51 without being transferred onto the intermediary transfer belt 44*b* during the primary transfer process (primary untransferred residual toner) is removed from the surface of the photosensitive drum 51 by the cleaning blade 55 and is collected in a collection container (not shown). The cleaning blade 55 is a plate-like member which is in contact with the photosensitive drum 51 with a predetermined pressing force. The cleaning blade 55 is in contact with the surface of the photosensitive drum 51 in a counter direction in which the outer end portion of the free end portion faces the upstream side in the rotational direction of the photosensitive drum 51. In addition, toner remaining on the intermediary transfer belt 44*b* without being transferred onto the recording material S during the secondary transfer process (secondary untransferred residual toner) or adhering matter such as paper dust is removed and collected from the surface of the intermediary transfer belt 44*b* by the belt cleaning device 60.

At an upper portion of the apparatus main assembly 10, an automatic original feeding device 81 and an image reading portion 80 are provided. The automatic original feeding device 81 automatically feeds, toward the image reading portion 80, a sheet (for example, a chart described later) such as an original or the recording material S on which the image is formed. The image reading portion 80 reads the image on the sheet fed by the automatic original feeding device 81. The image reading portion 80 illuminates the sheet placed on a plating glass 82 with light from a light source (not shown) and is constituted so as to read the image on the sheet, in terms of a dot density determined in advance, by an image reading element (not shown). That is, the image reading portion 80 optically reads the image on the sheet and converts the read image into an electric signal.

FIG. 2 is a block diagram showing in a schematic structure of a control system of the image forming apparatus 1 of this embodiment. As shown in FIG. 2, the controller 30 is constituted by a computer, and includes, for example, a CPU 31, a ROM 32 for storing a program for controlling each unit, a RAM 33 for temporarily storing data, and an input/output circuit (I/F) 34 for inputting/outputting signals to and from the outside. The CPU 31 is a microprocessor which controls the entire image forming apparatus 1 and is a main part of the system controller. The CPU 31 is connected to the feeding portion (not shown), the image forming portion 40, the discharge portion (not shown), and the operation portion 70 via the input/output circuit 34, and exchanges signals with these portions, and controls the operation of each of these portions. The ROM 32 stores an image formation control sequence for forming an image on the recording material S. The controller 30 is connected to a charging bias power source 73, a developing bias power source 74, a primary transfer power source 75, and a secondary transfer power source 76, which are controlled by signals from the controller 30, respectively. In addition, the controller 30 is connected to a temperature sensor 71, a humidity sensor 72, a voltage detection sensor 75*a* and a current detection sensor 75*b* of the primary transfer power supply 75, a voltage detection sensor 76*a* and a current detection sensor 76*b* of the secondary transfer power supply 76, and a fixing temperature sensor 77.

The operating portion 70 includes an operation button as input means, and a display portion 70*a* including a liquid crystal panel as display means. Here, in this embodiment, the display unit 70*a* is constituted as a touch panel, and also has a function as input means. The operators such as users and service personnel can execute a job (a series of operations to form and output an image or images on one or more recording materials S in response to one start instruction) by operating the operation portion 70. The controller 30 receives the signal from the operating portion 70 and operates various devices of the image forming apparatus 1. The image forming apparatus 1 can also execute the job on the basis of an image forming signal (image data, control command) supplied from an external device 200 such as a personal computer.

In this embodiment, the controller 30 includes an image formation pre-preparation process portion 31*a*, an ATVC process portion 31*b*, an image formation process portion 31*c*, and an adjustment process portion 31*d*. In addition, the controller 30 includes a primary transfer voltage storage/operation portion 31*e* and a secondary transfer voltage storage/operation portion 31*f*. Here, each of these process portions and storage/operation portions may be provided as a portion or portions of the CPU 31 or the RAM 33. For example, the controller 30 (specifically the image formation process portion 31*c*) can execute a print job as described above. In addition, the controller 30 (specifically the ATVC process portion 31*b*) can execute ATVC (setting mode) for the primary transfer portion and the secondary transfer portion. Details of the ATVC will be described hereinafter. In addition, the controller 30 (specifically the adjustment process portion 31*d*) can execute an operation in an adjustment mode for adjusting the setting voltage of the secondary transfer voltage. Details of the adjustment mode will be described hereinafter.

Here, the image forming apparatus 1 executes the job (image output operation, print job) which is series of operations to form and output an image or images on a single or a plurality of recording materials S started by one start instruction. The job includes an image forming step, a pre-rotation step, a sheet (paper) interval step in the case where the images are formed on the plurality of recording materials S, and a post-rotation step in general. The image forming step is performed in a period in which formation of an electrostatic image for the image actually formed and outputted on the recording material S, formation of the toner image, primary transfer of the toner image and secondary transfer of the toner image are carried out, in general, and during image formation (image forming period) refer to this period. Specifically, timing during the image formation is different among positions where the respective steps of the formation of the electrostatic image, the toner image formation, the primary transfer of the toner image and the secondary transfer of the toner image are performed. The pre-rotation step is performed in a period in which a preparatory operation, before the image forming step, from an input of the start instruction unit the image is started to be actually formed. The sheet interval step is performed in a period corresponding to an interval between a recording material S and a subsequent recording material S when the images are continuously formed on a plurality of recording materials S (continuous image formation). The post-rotation step is performed in a period in which a post-operation (preparatory operation) after the image forming step is performed. During non-image formation (non-image formation period) is a period other than the period of the image formation (during image formation) and includes the periods of the pre-rotation step, the sheet interval step, the post-rotation step and further includes a period of a pre-multi-rotation step which is a preparatory operation during turning-on of a main switch (voltage source) of the image forming apparatus 1 or during restoration from a sleep state.

2. Control of Secondary Transfer Voltage

Figure 3:
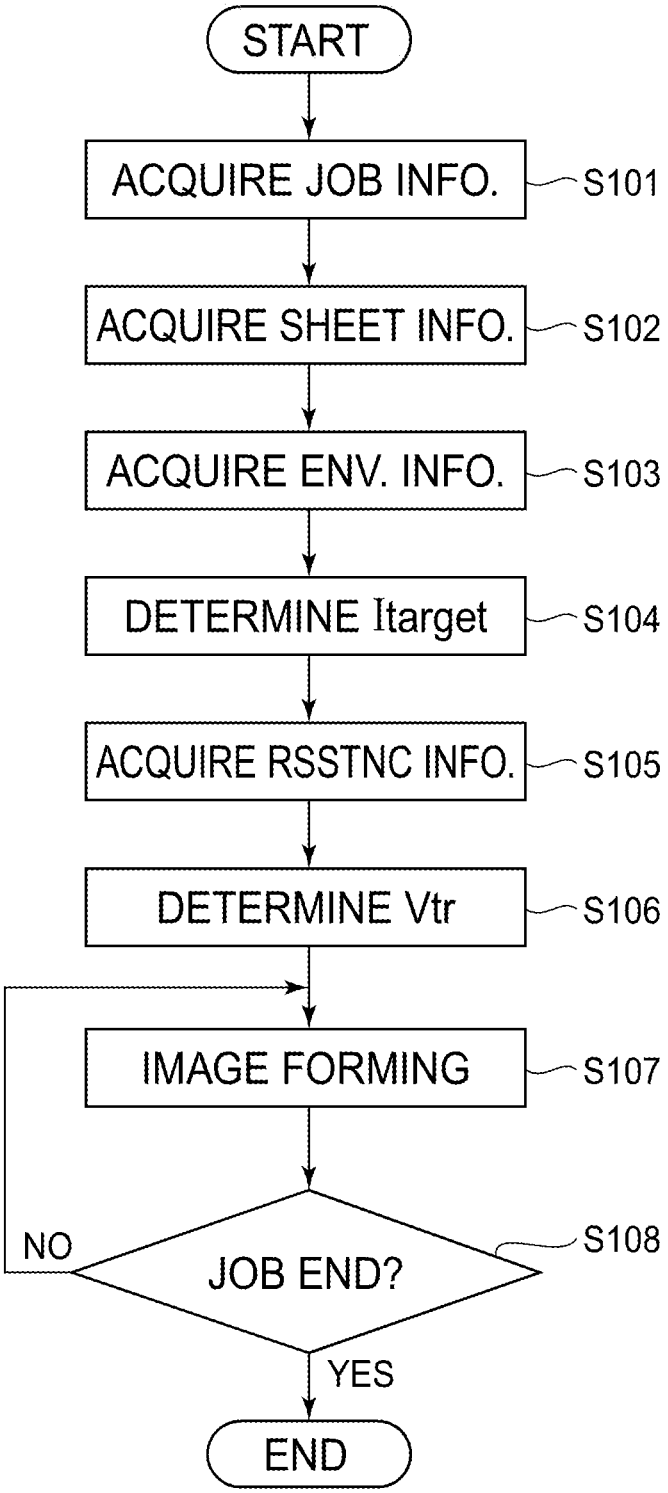
FIG. 3 is a flowchart showing an outline of a procedure of control of a secondary transfer voltage.

Next, control of the secondary transfer voltage will be described. FIG. 3 is a flow chart showing an outline of a procedure of the control of the secondary transfer voltage in this embodiment. Generally, the control of the secondary transfer voltage includes constant-voltage control and constant-current control, and in this embodiment, the constant-voltage control is used.

First, the controller 30 (image formation pre-preparation process portion 31*a*) causes the image forming portion to start an operation of a job when acquires information on the job from the operation portion 70 or the external device 200. In the information on this job, image information designated b an operator and information on the recording material S are included. Further, in this embodiment, the information on the recording material S includes a size (width, length) of the recording material S on the image is to be formed, information (thickness, basis weight and the like) relating to the thickness of the recording material S, and information relating to a surface property of the recording material S such that whether or not the recording material S is coated paper. Particularly, in this embodiment, the information on the recording material S includes information on the size of the recording material S and information on a kind (category of paper kind) of the recording material S such as "thin paper, plain paper, thick paper, . . . " relating to the thickness of the recording material S. Incidentally, the kind of the recording material S includes natures based on general characteristics such as plain paper, thick paper, thin paper, glossy paper, coated paper, and any distinguishable information on the recording material S, such as manufacturer, brand, product number, basis weight, thickness. The controller 30 (image formation pre-preparation process portion 31*a*) writes this job information in the RAM33 (S102).

Next, the controller 30 (image formation pre-preparation process portion 31*a*) acquires environment information detected by the temperature sensor 71 and the humidity sensor 72 (S103). In the ROM32, information showing correction between the environment information and a target current Itarget for transferring the toner image from the intermediary transfer belt 44*b* onto the recording material S is stored. The controller 30 (secondary transfer voltage storage/operation portion 31*f*) acquires the target current Itarget corresponding to the environment from the information showing the correlation between the environment information and the target current Itarget, on the basis of the environment information read in S103. Then, the controller 30 writes this target current Itarget in the RAM33 (or the secondary transfer voltage storage/operation portion 31*f*) (S104). Incidentally, why the target current Itarget is changed depending on the environment information is that the toner charge amount varies depending on the environment. The information showing the correlation between the environment information and the target current Itarget has been acquired in advance by an experiment or the like.

Figures 4, 5:
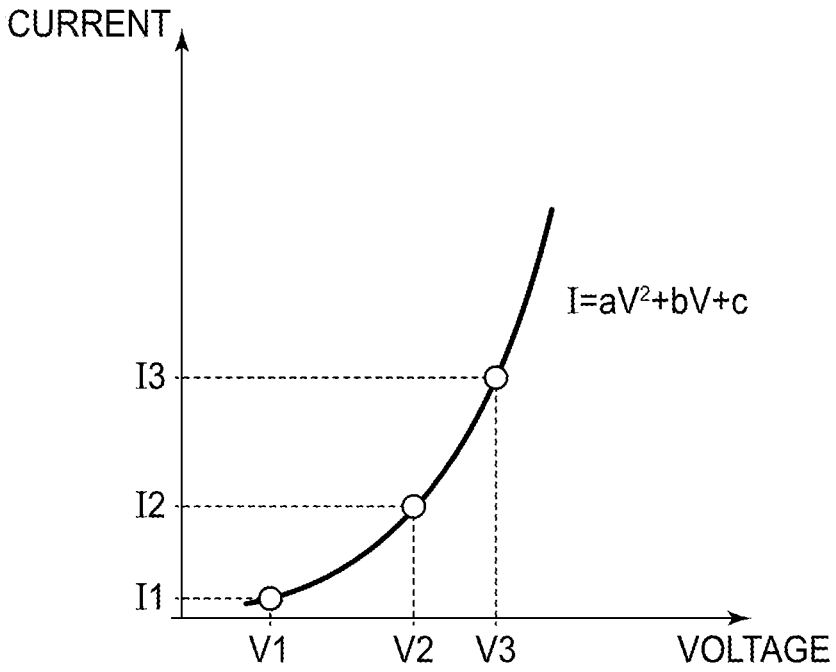
FIG. 4 is a graph showing a voltage-current characteristic acquired in the control of the secondary transfer voltage.
FIG. 5 is a schematic illustration showing an example of table data of a recording material part voltage.

Next, the controller 30 (ATVC process portion 31*b*) acquires information on an electric resistance of the secondary transfer portion N by the ATVC (active transfer voltage control) before the toner image on the intermediary transfer belt 44*b* and the recording material S onto which the toner image is transferred reach the secondary transfer portion N (S105). That is, in a state in which the outer secondary transfer roller 45*b* and the intermediary transfer belt 44*b* and contacted to each other, predetermined voltages of a plurality of levels are applied (supplied) from the secondary transfer voltage source 76 to the outer secondary transfer roller 45*b*. Then, current values when the predetermined voltages are applied are detected by the current detection sensor 76*b*, so that a relationship between the voltage and the current (voltage-current characteristic) as shown in FIG. 4 is acquired. The controller 30 writes information on this relationship between the voltage and the current in the RAM33 (or the secondary transfer voltage storage/operation portion 31*f*). This relationship between the voltage and the current changes depending on the electric resistance of the secondary transfer portion N. In the constitution of this embodiment, the relationship between the voltage and the current is not such that the current changes linearly relative to the voltage (i.e., is linearly proportional to the voltage), but is such that the current changes so as to be represented by a polynominal expression consisting of two or more terms of the voltage. For that reason, in this embodiment, in order that the relationship between the voltage and the current can be represented by the polynominal expression, the number of predetermined voltages or currents supplied when the information on the electric resistance of the secondary transfer portion N is acquired was three or more (levels).

Then, the controller 30 (secondary transfer voltage storage/operation portion 31*f*) acquires a voltage value to be applied from the secondary transfer voltage source 76 to the outer secondary transfer roller 45*b* (S106). That is, on the basis of the target current Itarget written in the RAM33 in S104 and the relationship between the voltage and the current acquired in S105, the controller 30 acquires a voltage value Vb necessary to cause the target current Itarget to flow in a state in which the recording material S is absent in the secondary transfer portion N. This voltage value Vb corresponds to a secondary transfer portion part voltage (transfer voltage corresponding to the electric resistance of the secondary transfer portion N. Further, in the ROM32, information for acquiring a recording material part voltage (transfer voltage corresponding to the electric resistance of the recording material S) Vp as shown in FIG. 5. In this embodiment, this information is set as table data indicating a relationship between water content and the recording material part voltage Vp in an ambient atmosphere for each of sections (corresponding to paper kind categories) of basis weights of recording materials S. Incidentally, the controller 30 (image formation pre-preparation process portion 31*a*) is capable of acquiring ambient water content on the basis of environment information (temperature, humidity) detected by the temperature sensor 71 and the humidity sensor 72. On the basis of the information on the job acquired in S101 and the environment information acquired in S103, the controller 30 acquires the recording material part voltage Vp from the above-described table data. Further, in the case where the adjusted value is set by the operation in the adjustment mode, described later, for setting the set voltage of the secondary transfer voltage, an adjustment value ΔV depending on the adjusted value. As described later, this adjustment value ΔV is stored in the RAM33 (or the secondary transfer voltage storage/operation portion 31*f*) in the case where the adjusted value is set by the operation in the adjustment mode. The controller 30 acquires Vb+Vp+ΔV which is the sum of the above-described voltage values Vb, Vp and ΔV, as a secondary transfer voltage Vtr applied from the secondary transfer voltage source 76 to the outer secondary transfer roller 45*b* when the recording material S passes through the secondary transfer portion N. Then, the controller 30 writs this Vtr (=Vb+Vp+ΔV) in the RAM33 (or the secondary transfer voltage storage/operation portion 31*f*). Incidentally, the table data for acquiring the recording material part voltage Vp as shown in FIG. 5 are acquired in advance by the experiment or the like.

Here, the recording material part voltage Vp also changes depending on a surface property of the recording material S other than the information (thickness, basis weight or the like) relating to the thickness of the recording material S in some instances. For that reason, the table data may also be set so that the recording material part voltage Vp changes also depending on the information relating to the surface property of the recording material S. Further, in this embodiment, the information relating to the thickness of the recording material S (and in addition, the information relating to the surface property of the recording material S) are included in the job information acquired in S101. However, a measuring means or detecting the thickness of the recording material S and the surface property of the recording material S is provided in the image forming apparatus 1, and the recording material part voltage Vp may also be acquired on the basis of information acquired by this measuring means.

Next, the controller 30 (the image formation process portion 31*c*) causes the image forming portion to form the image and to send the recording material S to the secondary transfer portion N and causes the secondary transfer device to perform the secondary transfer by applying the secondary transfer voltage Vtr determined as described above (S107). Thereafter, the controller 30 (the image formation process portion 31*c*) repeats S107 until all the images in the job are transferred and completely outputted on the recording material S (S108).

Incidentally, also as regards the primary transfer portion 48, the ATVC similar to the above-described ATVC is carried out in a period from a start of the job until the toner image is fed to the primary transfer portion 48, but detailed description will be omitted in this embodiment.

3. Outline of Simple Adjustment Mode

Next, an operation in a simple adjustment mode (hereinafter simply referred to as an "adjustment mode) for setting the set voltage of the secondary transfer voltage will be described. Depending on the type and condition of the recording material S used in image formation, the kind water (moisture) content and electrical resistance value of the recording material S may differ greatly from the standard recording material S. In this case, optimal transfer may not be performed with the set voltage of the secondary transfer voltage using the default recording material part voltage Vp set in advance as described above.

That is, first, the secondary transfer voltage needs to be a voltage necessary for transferring the toner from the intermediary transfer belt 44*b* to the recording material S. In addition, the secondary transfer voltage must be suppressed to a voltage level with which the abnormal discharge does not occur. However, depending on the type and state of the recording material S actually used for image formation, the electrical resistance may be higher than the value assumed as a standard value. In such a case, the voltage required to transfer the toner from the intermediary transfer belt 44*b* to the recording material S may be insufficient with the set secondary transfer voltage using the preset default recording material part voltage Vp. Therefore, in this case, it is desired to increase the set voltage of the secondary transfer voltage by increasing the recording material part voltage Vp. On the contrary, depending on the type and condition of the recording material S actually used for image formation, the water (moisture) content of the recording material S may have increased, with the result that the electrical resistance is lower than the value assumed as a standard value, and therefore, the electrical discharge may be likely to occur. In this case, with the setting voltage of the secondary transfer voltage using the preset default recording material part voltage Vp, image defects may occur due to the abnormal discharge. Therefore, in this case, it is desirable to lower the set voltage of the secondary transfer voltage by reducing the recording material part voltage Vp.

Therefore, it is desired that the operator such as a user or a service person adjusts (changes) the recording material part voltage Vp depending on the recording material S actually used for image formation, for example, to optimize the setting voltage of the secondary transfer voltage during the execution of the job. That is, it is desired that an optimum recording material part voltage Vp+Vb (adjustment amount) depending on the recording material S actually used for image formation is selected. This adjustment may be performed by the following method. That is, for example, the operator outputs the images while switching the secondary transfer voltage for each recording material S, and confirms the presence or absence of an image defect occurring in the output image to obtain an optimal secondary transfer voltage, on the basis of which setting voltage (specifically the recording material part voltage Vp+ΔV) of the optimum secondary transfer voltage is determined. However, in this method, since the outputting operation of the image and the adjustment of the setting voltage of the secondary transfer voltage are repeated, the recording material S which is wasted increases, and it takes time in some instances.

In this embodiment, the image forming apparatus 1 is operable in the adjustment mode in which the setting voltage of the secondary transfer voltage is adjusted. In this operation in the adjustment mode, a chart on which a plurality of representative color patches (test images, test patterns, test toner images are formed) is outputted on the recording material S which is actually used for image formation, while the setting voltage of the secondary transfer voltage (test voltage) is switched for each patch. And, the optimal setting voltage (more specifically, the recording material part voltage Vp+ΔV of the secondary transfer voltage) is determined on the basis of a result of reading of the outputted chart by the image reading portion 80. Particularly, in this embodiment, on the basis of brightness information (density information) of a solid patch (solid image patch) on the chart, information on a recommended adjustment amount ΔV of a setting voltage of a secondary transfer voltage for optimizing a solid image density is presented. As a result, necessity that the operator confirms the presence or to absence of the image defect by eye observation is reduced, so that it becomes possible to more appropriately adjust setting of the secondary transfer voltage while alleviating an operation load of the operator.

However, as described above, at the setting voltage of the secondary transfer voltage selected from the result of reading of the patch, an absolute value of the secondary transfer voltage is excessively large and the "white void" occurs in some cases. Since the "white void" is liable to be visualized in the half-tone image, as the image density, it is difficult to distinguish the difference between the occurrence or non-occurrence of the "white void".

Therefore, in this embodiment, the image forming apparatus 1 is capable of restricting a range of the adjustment amount when the setting voltage of the secondary transfer voltage is adjusted on the basis of the brightness information of the patch in the operation in the adjustment mode. As will be described later specifically, it has been known that the recording material part voltage at which the "white void" is liable to occur has a correlation to the information (thickness or basis weight) relating to the thickness of the recording material S. For that reason, in this embodiment, when the setting voltage of the secondary transfer voltage is adjusted on the basis of the brightness information of the patch in the operation in the adjustment mode, the image forming apparatus 1 is capable of restricting the range of the adjustment amount on the basis of the information on the thickness of the recording material S.

4. Chart

In this embodiment, in the operation in the adjustment mode, the brightness information of the patch is acquired by reading an outputted chart by the image reading portion 80, and a recommended adjustment amount of the setting voltage of the secondary transfer voltage is presented. Particularly, in this embodiment, on the basis of brightness information of a solid patch of secondary color (blue in this embodiment), the recommended adjustment amount of the setting voltage of the secondary transfer voltage for optimizing the solid image density is presented. At this time, in this embodiment, by restricting the range of the adjustment amount of the setting voltage of the secondary transfer voltage on the basis of the information on the thickness of the recording material S, it is possible to prevent adjustment of the setting voltage to a setting voltage at which the "white void" which is liable to be visualized in the half-tone image. Further, in this embodiment, the operator visually recognizes the outputted chart in the operation in the adjustment mode, so that it is also possible to change the adjustment amount presented as described above. For that reason, in this embodiment, on the chart, in addition to the solid patch, a half-tone patch (patch of the half-tone image) is formed. Incidentally, in the case where a constitution in which the operator is capable of changing the adjustment amount is not employed, the half-tone patch is not needed.

When confirmation of the outputted chart through eye observation by the operator is also taken into consideration, the larger the patch size of the chart that is outputted in the adjustment mode, the more advantageous is since then it is easier to check for image defects. However, if the patch is large, the number of patches which can be formed on one recording material S is reduced. The patch shape can be square and so on. The color of the patch can be determined by the image defect to be checked and by the easiness of checking. For example, when the secondary transfer voltage is increased from a low value, the lower limit of the secondary transfer voltage can be determined from the voltage value at which the secondary color patches such as red, green, and blue can be properly transferred. In addition, in the case where the operator confirms the outputted chart by eye observation, when the secondary transfer voltage is further increased, the upper limit value of the secondary transfer voltage can be determined from the voltage value at which image failure (defect) occurs due to the high secondary transfer voltage in the halftone patch.

Figure 6:
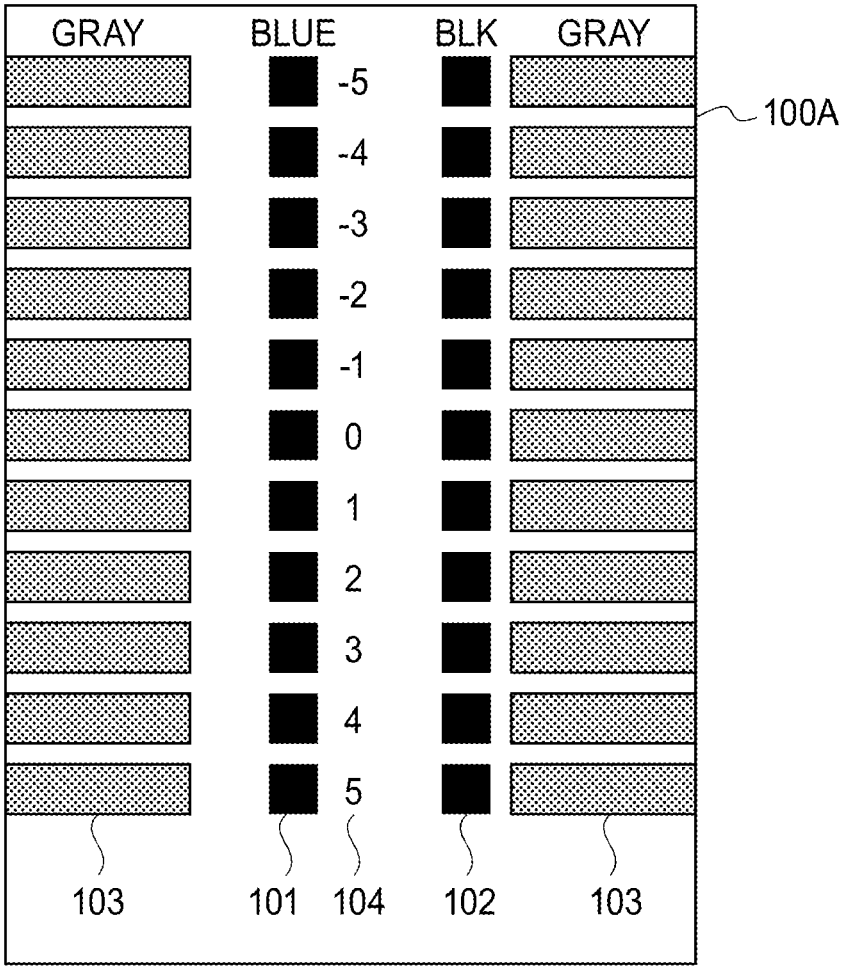
FIG. 6 is a schematic illustration of chart image data outputted in an operation in an adjustment mode.

A chart usable with the adjustment mode in this embodiment will be described. In the adjustment mode in this embodiment, two types of image data 100A and 100B shown in FIG. 6 and parts (a) and (b) of FIG. 7 are used for output of a chart 100. FIG. 6 shows chart image data (hereinafter also referred to as "large chart data") 100A outputted to the recording material S having a length in the feed direction of 420 to 487 mm. FIG. 7 shows chart image data (hereinafter also referred to as "small chart data") outputted to the recording material S having a length in the feed direction of 210 to 419 mm. In this embodiment, as the chart image data, only two types of image data shown in FIGS. 6 and 7 are set. And, in the adjustment mode, the chart corresponding to the image data cut out from any one of the two types of image data shown in FIGS. 6 and 7 depending on the size of the recording material S to be used is outputted on the recording material S. At this time, in this embodiment, image data having a size obtained by subtracting the margins at the end of the recording material S (in this embodiment, both ends in the thrust direction and both ends in the feed direction) from the image data shown in FIGS. 6 and 7 is cut out.

Here, in this embodiment, the maximum size (maximum sheet passing size) of the recording material S on which the image forming apparatus 1 can form an image is 13 inches× 19.2 inches (longitudinal feed). In addition, in the following description, the directions of the large chart data 100A and the small chart data 100B corresponding to the "feeding direction" and "thrust direction (substantially perpendicular to the feeding direction)" of the recording material S are also referred to as "feeding direction" and "thrust direction", respectively.

The large chart data 100A shown in FIG. 4 will be further described. The large chart data 100A corresponds to the maximum sheet passing size of the image forming apparatus 1 of this embodiment, and the image size is approx. (thrust direction) 13 inches (≈330 mm) at the short side)×(feeding direction) 19.2 inches (≈487 mm) at the long side. When the size of the recording material S is 13 inches×19.2 inches (vertical feed) or less and more than A3 size (vertical feed), the part to which this large chart data 100A is cut according to the size of the recording material S is outputted. That is, when the length of the recording material S in the feeding direction is 420 to 487 mm, the large chart data 100A is used. At this time, in this embodiment, the image data is cut out from the large chart data 100A in accordance with the size of the recording material S based on the leading end center. That is, the leading end portion in the feeding direction of the recording material S and the leading end portion (upper end portion) in the long side direction of the large chart data 100A are aligned with each other, and the center in the thrust direction of the recording material S and the center in the short side direction of the large chart data 100A are aligned with each other, the image data is cut out of the large chart data 100A. In addition, at this time, in this embodiment, the image data is cut out from the large chart data 100A such that a margin of 2.5 mm is provided at the ends of the recording material S (both ends in the thrust direction and both ends in the feed direction in this embodiment). For example, in the case where of the chart 110 is outputted to the recording material S of A3 size (vertical feed) (short side 297 mm×long side 420 mm), the image data having a size of 292 mm (short side)×415 mm long side is cut out from the large chart data 100A. And, the image corresponding to the cut-out image data is outputted on an A3 size recording material S with a margin of 2.5 mm at each end portion with the leading end center being the reference position.

The large chart data 100A includes one blue solid patch 101, one black solid patch 102, and two halftone patches 103 (gray (black halftone) in this embodiment) arrange in the thrust direction. And, eleven sets of patch sets 101 to 103 in the thrust direction are arranged in the feed direction. The blue solid patch 101 and the black solid patch 102 are each 25.7 mm×25.7 mm square (one side is substantially parallel to the thrust direction). In addition, each of the halftone patches 103 at both ends has a width of 25.7 mm in the feed direction, and extends to the end of the large chart data 100A in the thrust direction. In addition, the interval between the patch sets 101 to 103 in the feed direction is 9.5 mm. The secondary transfer voltage is switched at the timing when the portion on the chart corresponding to this interval passes through the secondary transfer portion N. The 11 patch sets 101-103 in the feed direction of the large chart data 100A are within the range of 387 mm in the feed direction such that when the size of the recording material S is A3, they are within the length 415 mm of the recording material S in the feed direction. In addition, in this example, the large chart data 100A includes identification information 104 for identifying the setting of the secondary transfer voltage applied to each patch set in conjunction with each of 11 patch sets 101 to 103 in the feed direction. In this embodiment, this identification information 104 corresponds to an adjusted (adjustment) value described later. In this embodiment, eleven pieces of identification information 104 (−5 to 0 to +5 in this embodiment) corresponding to eleven steps of secondary transfer voltage settings are provided.

When the eye observation by the operator is also taken into consideration, the size of the patch is required to be large enough to permit the operator to easily determine whether there is an image defect or not. For the transferability of blue solid patch 101 and black solid patch 102, if the size of the patch is small, it can be difficult to discriminate the defect, and therefore, the size of the patch is preferably 10 mm square or more, and is 25 mm square or more it is further preferable. The image defects due to abnormal discharge which occur when the secondary transfer voltage is increased in the halftone patch 103 are often in the form of white spots. This image defect tends to be easy to discriminate even in a small size image, compared to the transferability of the solid image. However, it is easier to observe if the image is not too small, and therefore, in this embodiment, the width of the halftone patch 103 in the feed direction is the same as the width of the blue solid patch 101 and the black solid patch 102 in the feed direction. In addition, the interval between the patch sets 101 to 103 in the feed direction may be set so that the secondary transfer voltage can be switched.

Here, it is preferable to prevent patches from being formed in the neighborhood of the leading and trailing ends of the recording material S in the feeding direction (for example, in the range of about 20 to 30 mm inward from the edge). The reason for this will be described. That is, of the end portions in the feeding direction of the recording material S, there may be an image defect that occurs only at the leading end or the trailing end. This is because in this case, it may be difficult to determine whether or not an image defect has occurred because the secondary transfer voltage is changed. The solid image is an image with a maximum density level. In addition, in this embodiment, the half-tone image corresponds to an image with a toner application amount of 10% to 80% when the toner application amount of the solid image is 100%.

Using the large chart data 100A described above, as the size of the recording material S becomes smaller than 13 inches (A3 size or more), the length, in the thrust direction, of the halftone patch 103 at both ends in the thrust direction becomes smaller. In addition, using the large chart data 100A as described above, as the size of the recording material S becomes smaller than 13 inches (however, A3 size or more), the margin at the trailing end in the feed direction becomes smaller.

The small chart data 100B shown in FIG. 7 will be further described. The small chart data 100B corresponds to a size smaller than the A3 size, and the image size is approximately long side (thrust direction) 13 inches (≈330 mm)×short side (feeding direction) 210 mm. If the size of the recording material S is A5 (short side 148 mm×long side 210 mm) (longitudinal feed) or more and smaller than A3 size (longitudinal feed), a chart corresponding to the image data cut out of the small chart data 100B depending on the size of the recording material S is outputted. That is, when the length of the recording material S in the feeding direction is 210 to 419 mm, the small chart data 100B is used. At this time, in this embodiment, the image data is cut out of the small chart data 100B in accordance with the size of the recording material S on the basis of the leading end center. In addition, at this time, in this example, as with the large chart data 100A, image data is cut out from the small chart data 100B so as to be provided with a margin of 2.5 mm at the ends of the recording material S (both ends in the thrust direction and both ends in the feed direction in this embodiment). As will be described hereinafter, the small chart data 100B is smaller in length in the feed direction than the large chart data 100A, and therefore, the number of patch sets which can be arranged in the feed direction is smaller than that of the large chart data 100A. Therefore, when the small chart data 100B is used, two charts are outputted in order to increase the number of patches.

The small chart data 100B has the same patches as those of the large chart data 100A. And, in the small chart data, five sets of patch sets 101 to 103 in the thrust direction are arranged in the feed direction. The five patch sets 101 to 103 in the feeding direction of the small chart data 100B are arranged in a range of 167 mm in length in the feeding direction. In addition, in this example, the small chart data 100B is provided with identification information 104 for identifying the setting of the secondary transfer voltage applied to each set of patch sets, in association with the respective ones of the five patch sets 101 to 103 in the feed direction. As described above, when the small chart data 100B is used, two charts are outputted. And, on the first sheet, based on the small chart data 100B shown in part (a) of FIG. 7, five pieces of identification information 104 (−4 to 0 in this embodiment) corresponding to the setting of the lower secondary transfer voltage in five steps are arranged. In addition, on the second sheet, based on the small chart data 100B shown in part (b) of FIG. 7, five (1 to 5 in this embodiment) identification information 104 corresponding to higher five-level secondary transfer voltage settings are arranged.

Using the above small chart data 100B, as the size of the recording material S becomes smaller (however, smaller than the A3 size and larger than the A5 size), the length, in the thrust direction, of the halftone patch 103 at both ends in the thrust direction becomes smaller. In addition, using the small chart data 100B as described above, as the size of the recording material S becomes smaller (however, smaller than the A3 size and larger than the A5 size), the margin at the trailing end in the feed direction becomes smaller.

Here, in this embodiment, not only a standard size but also an arbitrary size (A5 size or more, 13 inches×19.2 inches or less) recording material S is usable by an operator inputting and designating on the operation portion 70 or the external device 200.

5. Operation in Adjustment Mode

FIG. 8 is a flowchart showing an outline of the process of the adjustment mode in this embodiment. In addition, FIG. 9 is a schematic illustration of an example of a setting screen. Here, a case where the operator executes the adjustment mode operation using the operation portion 70 of the image forming apparatus 1 will be described as an example.

First, the operator selects the type and size of the recording material S using with the adjustment mode (S1). At this time, the controller 30 (adjustment process portion 3*d*) causes the operation portion 70 to display a setting screen (not shown) for the type and size of the recording material S. The controller 30 (adjustment process portion 31*d*) acquires information on the type and size of the recording material S designated by the operator in the operation portion 70. Here, for information on the type and size of the recording material S, for example, the information may be acquired by selecting the cassette of the feeding portion which contains the recording material S, in which the type and size of the recording material S set in advance in association with the cassette.

Next, the operator sets the central voltage value of the secondary transfer voltage applied at the time of chart output, and whether to output the chart to one side or both sides of the recording material S (S2). In this embodiment, in order to be able to adjust the secondary transfer voltage during secondary transfer to the front side (first side) and back side (second side) in duplex printing, the chart can be outputted on both sides of the recording material S also in the adjustment mode. Therefore, in this example, it is possible to select whether to output the chart to one side or both sides of the recording material S, and the center voltage value of the secondary transfer voltage can also be set for each of the front side and the back side of the recording material S. At this time, the controller 30 (adjustment process portion 31*d*) causes the operation portion 70 to display an adjustment mode setting screen 90 as shown in FIG. 9. The setting screen 90 has a voltage setting portion 91 for setting the center voltage value of the secondary transfer voltage for the front and back sides of the recording material S. In addition, the setting screen 90 has an output side selection portion 92 for selecting whether to output the chart to one side or both sides of the recording material S. Furthermore, the setting screen 90 includes an output instruction portion (test page output button) 93 for instructing chart output, a confirmation portion 94 (OK button 94*a* or the apply button 94*b*) for confirming the setting, and a cancel button 95 for canceling the setting change. When adjustment value 0 is selected in voltage setting portion 91, a preset voltage (more specifically, the recording material part voltage Vp) set in advance for the currently selected recording material S is selected. And, the case that adjustment value 0 is selected will be considered in which 11 sets of patches from −5 to 0 to +5 when large chart data is used, and 10 sets of patches from −4 to 0 to +5 when small chart data is used, are switched and applied as the secondary transfer voltages. In this embodiment, description will be made on assumption that the large chart data is used and the chart including the 11 sets of patches is outputted. In this embodiment, the difference in secondary transfer voltage for one level is 150V. The controller 30 (adjustment process portion 31*d*) acquires information relating to the setting such as the center voltage value set by way of the setting screen 90 in the operation portion 70.

Next, when the output instruction portion 93 on the setting screen 90 is selected by the operator, the controller 30 (adjustment process portion 31*d*) acquires information on the electric resistance of the secondary transfer portion N when the recording material S is absent in the secondary transfer portion N (S3). In this embodiment, the controller 30 (adjustment process portion 31*d*) acquires a polynomial expression (quadratic expression in this embodiment) of two or more terms (terms of the second degree or more) with respect to a voltage-current relationship depending on the electric resistance of the secondary transfer portion N by an operation similar to the operation in the above-described ATVC. The controller 30 (adjustment process portion 31*d*) writes information on this voltage-current relationship in the RAM33 (or adjustment process portion 31*d*).

Then, the controller 30 (adjustment process portion 31*d*) causes the image forming apparatus to output the chart (S4). At this time, the controller 30 (adjustment process portion 31*d*) cuts out t chart data as described above on the basis of the size information of the recording material S acquired in S11 and causes the image forming apparatus to output the chart on which the 11 sets of patches are transferred while changing the secondary transfer voltage every 150 V. For example, it is assumed that the recording material per voltage in the present environment is 2500 V, and the secondary transfer portion part voltage Vb acquired from the result of the ATVC is 1000 V. In this case, from 2650 V to 4250 V, the chart on which the 11 sets of patches are transferred while changing the secondary transfer voltage every 150 V. At this time, the controller 30 (adjustment process portion 31*d*) causes the current detection sensor 76*b* to detect a value of the current flowing during application of voltages of respective voltage levels, and acquires information on the electric resistances of the secondary transfer portion N and the recording material S when the recording material S is present in the secondary transfer portion N (S5). In this embodiment, the controller 30 (adjustment process portion 31*d*) acquires, from a detection result of currents for voltages of 11 levels, the polynominal expression (quadratic expression in this embodiment) of two or more terms with respect to the voltage-current relationship depending on the electric resistances of the secondary transfer portion N and the recording material S. The controller 30 (adjustment process portion 31*d*) writes the information on the voltage-current relationship in the RAM 33 (or adjustment process portion 31*d*). Incidentally, the current when the recording material S is present in the secondary transfer portion N may typically be detected during transfer of the patch, but may also be detected at a portion of the recording material S where there is no toner before and after the patch for each voltage level.

Then, the controller 30 (adjustment process portion 31*d*) acquires the recording material part voltage Vp(n) at each of the voltage levels from the relationship (quadratic expression) between the voltage and the current, when the recording material S is present in the secondary transfer portion N, acquired in S5 and from the relationship (quadratic expression) between the voltage and the current, when the recording material S is present in the secondary transfer portion N, acquired in S3 (S6). Here, n represents each of the voltage levels, and in this embodiment, n ranges from 1 to 11 corresponding to the 11 levels (11 sets of patches). Further, the voltage value of each voltage level is represented by Vtr(n). Further, the voltage value calculated by applying each level to the relationship (quadratic expression) between the voltage and the current, when the recording material S is absent in the secondary transfer portion N, acquired in S3 is represented by Vb(n). At this time, recording material part voltage Vp(n) at each voltage level is represented by the following equation: $Vp(n)=Vtr(n)-Vb(n)$.

Then, the outputted chart is supplied to the image reading portion 80 by using the automatic original feeding device 81, for example, so that the chart is read by the image reading portion 80 (S7). At this time, the image reading portion 80 is controlled by the controller 30 (adjustment process portion 31*d*), and in this embodiment, RGB brightness data (8 bit) of each of the solid blue patches on the chart are acquired. Incidentally, when the chart is outputted, the controller 30 (adjustment process portion 31*d*) is capable of causing the operation portion 70 to display a message prompting the operator to supply the outputted chart to the image reading portion 80. Next, the controller 30 (adjustment process portion 31*d*) acquires an average of values of the brightness of the respective patches by using the brightness data (density data) acquired in S7 (S8). By this process of S8, as an example, an average of the values of the brightness of the patches corresponding to the respective voltage levels as shown in FIG. 10. In FIG. 10, the abscissa represents the adjusted (adjustment) values (−5 to 0 and 0 to +5) showing the respective voltage levels, and the ordinate represents the average of the values of the brightness of the solid blue patches. Incidentally, as regards the solid blue patches, brightness data of B are used.

Then, the controller 30 (adjustment process portion 31*d*) acquires the adjusted value showing the recommended adjustment amount ΔV of the setting voltage of the secondary transfer voltage on the basis of the recording material part voltage Vp(n) acquired in S6 and the average of the brightness acquired in S8 (S9).

Here, the process of acquiring the adjusted value in S9 will be specifically described. FIG. 11 is a graph showing an outline of among the thickness of the recording material S, the recording material part voltage of the secondary transfer voltage and liability of the occurrence of the "white void". As shown in FIG. 11, it turns out that as the thickness of the recording material S becomes thick, the absolute value of the recording material part voltage at which the "white void" occurs becomes larger. According to study by the present inventor, the recording material part voltage at which the "white void" is liable to occur well coincides with an electric discharge start voltage acquired from the Paschen curve in the case where the thickness of the recording material S is regarded as air (gap). That is, the relationships shown in FIG. 11 coincides with cause of occurrence of the "white void" such that the recording material S is discharged during the secondary transfer and the toner at the discharged portion is reversed in charge polarity and thus is not transferred onto the recording material S. Therefore, in this embodiment, by utilizing the above-described correlation, an upper limit of the recording material part voltage is provided depending on the information on the thickness of the recording material S. As a result, it becomes possible to select the adjusted value of the setting voltage of the secondary transfer voltage within a range in which the occurrence of the "white void" can be suppressed.

Specifically, in this embodiment, the controller 30 (adjustment process portion 31*d*) extracts, from the recording material part voltage Vp(n) acquired in S6, a value which does not exceed the upper limit set depending on the information on the thickness of the recording material S. In this embodiment, every kind (paper category) of the recording material S such as "thin paper, plain paper, thick paper 1, thick paper 2, . . . ", a relationship between the information (basis weight in this embodiment) on the thickness of the recording material S and the upper limit of the recording material part voltage Vp(n) is acquired in advance. The relationship between the kind of the recording material S and the recording material part voltage Vp(n) is stored, as the table data as shown in FIG. 12, in the ROM 32. The controller 30 (adjustment process portion 31*d*) makes reference to the table data of FIG. 12 and acquires the upper limit of the recording material part voltage Vp(n) corresponding to the kind of the recording material S acquired in S1.

FIG. 13 is a graph for illustrating a process for acquiring the adjusted value in S9. Part (a) of FIG. 13 shows a relationship between the adjusted value (−5 to 0 and 9 to +5) indicating each of the voltage levels and the recording material part voltage Vp(n) acquired in S6. Part (b) of FIG. 13 shows a relationship between the adjusted value (−5 to 0 and 0 to +5) indicating each of the voltage levels and the average of brightness of the solid blue patch acquired in S8. For example, in an example of part (a) of FIG. 13, in the case where the upper limit of the recording material part voltage Vp(n) is 2200 V, the controller 30 (adjustment process portion 31*d*) extracts −5 to 0 as the adjusted value. Incidentally, the term "extracts" includes not only employment of one applicable to a predetermined condition as an option but also exclusion of one not applicable to the predetermined condition from the option. Further, the controller 30 determines, as an adjusted value indicating a recommended adjustment amount ΔV of the setting value of the secondary transfer voltage, the adjusted value, of the adjusted values discriminated as that the recording material part voltage Vp(n) does not exceed the upper limit, at which the average of the brightness of the corresponding patch is minimum (i.e., the image density is maximum). For example, in an example of part (b) of FIG. 13, the controller 30 (adjustment process portion 31*d*) determines, as the adjusted value indicating the recommended adjustment amount ΔV, −1 which provides a minimum average of the brightness of the corresponding patch, among −5 to 0 which are adjusted values extracted as described above. Incidentally, the case where the average of the brightness is minimum corresponds to the case where the average of the density is maximum.

Here, in the case where the adjusted value for setting of the secondary transfer voltage is determined on the basis of only the patch brightness data as in the conventional constitution, the brightness data becomes minimum at a value not less than the upper limit of the recording material part voltage in some instances, so that there is a liability that the adjustment amount in which there is a possibility of the occurrence of the "white void" is determined. On the other hand, according to this embodiment, the adjustment amount in which there is a possibility of the occurrence of the "white void" is avoided, so that an appropriate adjustment amount can be determined.

Next, the controller 30 (adjustment process portion 31*d*) causes the operation portion 70 to display the adjusted value acquired in S9 at the setting screen 90 (voltage setting portion 91) as shown in FIG. 9 (S10). The operator is capable of discriminating whether or not the displayed adjusted value is appropriate, on the basis of the display contents of the setting screen 90 and the outputted chart. The operator selects a finalizing portion 94 (OK button 94*a*, application button 94*b*) of the setting screen 90 as it is in the case where the displayed adjusted value is not changed. On the other hand, the operator inputs a desired value to the voltage setting portion 91 of the setting screen 90 in the case where the operator desires that the adjusted value is changed from the displayed adjusted value, and then selects the finalizing portion 94 (OK button 94*a*, application button 94*b*). In the case where the adjusted value is not changed and the finalizing portion 94 is selected (S11), the controller 30 (adjustment process portion 31*d*) causes the RAM 33 (or the secondary transfer voltage storage/operation portion 318) to store the adjusted value determined in S9 (S12). On the other hand, in the case where the adjusted value is changed (S11), the controller 30 (adjustment process portion 31*d*) causes the RAM 33 (or the secondary transfer voltage storage/operation portion 31*f*) to store the adjusted value inputted by the operator (S13). The operation in the adjusting mode is thus ended.

During execution of a subsequent job, the controller 30 calculates the adjustment amount ΔV=adjusted value×150 V depending on the adjusted value stored in the operation in the adjustment mode until the operation in the adjustment mode is subsequently executed, and uses the calculated value in calculation of the secondary transfer voltage Vtr during normal image formation.

Incidentally, the information on the upper limit of the recording material part voltage Vp(n) used in S9 described above is not limited to use in setting as the table data as in this embodiment. For example, a relational expression showing a relationship between the information on the thickness of the recording material S and the recording material part voltage Vp(n) at which the "white void" is liable to occur is acquired in advance and can be stored in the ROM 32. In this case, the information on the thickness is acquired and the upper limit of the recording material part voltage Vp(n) can be acquired from the above-described relational expression.

Further, the information on the thickness of the recording material S is not limited to classification by the kind of the recording material S. For example, in the above-described S1, the operator is capable of directly inputting a value relating to the thickness of the recording material S, such as the thickness or the basis weight. Further, in the step corresponding to S1, the value relating to the thickness of the recording material S, such as the thickness or the basis weight may also be acquired by a measuring means for measuring the value relating to the thickness of the recording material S. As the measuring means, for example, a known thickness sensor using ultrasonic wave can be provided on a side upstream of the secondary transfer portion N with respect to the feeding direction of the recording material S.

In this embodiment, as the patch for acquiring the brightness data, the solid blue patch was used but is not limited thereto. For example, instead of the solid blue patch, a solid patch of red or green which is a secondary color an be used, and a solid patch of a single color of yellow, magenta, cyan or black can be used.

In this embodiment, the case where the operation by the operator is performed through the operation portion 70 of the image forming apparatus 1 and thus the operation in the adjustment mode is executed was described as an example, but the operation in the adjustment mode may also be executed by operation through external device 20 such as a personal computer. In this case, it is possible to make setting similar to the above-described setting, through the setting screen displayed at the display portion of the external device 200, by a driver program for the image forming apparatus 1 installed in the external device 200.

In this embodiment, the information on the electric resistance of the secondary transfer portion N from a start of the operation in the adjustment mode when the recording material S is absent in the secondary transfer portion N was acquired. As a result, the information on the electric resistance of the secondary transfer portion N in conformity with a situation when the adjustment amount for setting of the secondary transfer voltage is acquired can be acquired. However, if allowed from the viewpoint of accuracy or the like, as the information on the electric resistance of the secondary transfer portion N, for example, a result of ATVC at the time of a start of the last job in which the operation in the adjustment mode is executed may also be used.

In this embodiment, in the operation in the adjustment mode, control using display of the adjusted value corresponding to the adjustment amount ΔV was carried out, but control more directly using the display of the adjustment value ΔV may also be carried out.

In this embodiment, when the voltage-current relationship is acquired, the value of the current flowing during supply of the predetermined voltage was detected, but a value of the voltage generating during supply of a predetermined current value may also be detected. In this embodiment, the constant-voltage control was described as an example, but the present invention is also applicable to a constitution using the constant-current control.

As described above, the image forming apparatus 1 of this embodiment includes the detection means 76*a* and 76*b* for detecting the current value or the voltage value when the voltage is applied from the voltage source 76 to the transfer member 45*b* and includes the acquiring means 80 for acquiring the information on the density of the image on the recording material S. Further, the image forming apparatus 1 includes the controller 30 capable of executing the operation in the mode in which the chart 100 on which the test images are transferred onto the recording material S by applying a plurality of different test voltages from the voltage source 76 to the transfer member 45*b* is outputted and in which on the basis of a result of detection of the chart 100 by the acquiring means 80, the transfer voltage applied to the transfer member 45*b* when the recording material S passes through the transfer portion N during image formation is set. During the operation in the above mode, the controller 30 sets the transfer voltage on the basis of the result of the detection by the detection means 76*a* and 76*b* when the plurality of test voltages are applied to the transfer member 45*b* when the chart 100 is present in the transfer portion N. In this embodiment, the controller 30 sets the transfer voltage on the basis of a first detection result by the detection means 76*a* and 76*b* acquired under application of the voltage with a positive absolute value to the transfer member 45*b* when the recording material S is absent in the transfer portion N and a second detection result by the detection means 76*a* and 76*b* under application of the plurality of voltages to the transfer member 45*b* when the recording material S is present in the transfer portion N in the operation in the above-described adjustment mode.

In this embodiment, during the operation in the mode, the controller 30 sets the transfer voltage on the basis of the information on the thickness of the recording material S used for outputting the chart 100. Specifically, the controller 30 sets the transfer voltage in the following manner. That is, the information on the voltage-current characteristic is acquired on the basis of the detection result by the detection means 76*a* and 76*b* acquired under application of the voltages of the plurality of levels from the voltage source 76 to the transfer member 45*b* when the recording material S is absent in the transfer portion N. Further, the transfer portion part voltage corresponding to each of the plurality of test voltages is acquired on the basis of the voltage-current characteristic and each of the plurality of current values detected by the detection means 76*a* and 76*b* corresponding the associated one of the plurality of test voltages applied to the transfer member 45*b* when the recording material S is present in the transfer portion N during the output of the chart 100. Then, of the plurality of test voltages, a single or a plurality of voltages capable of being reflected in the transfer voltage is extracted on the basis of the information on the thickness of the recording material S used for outputting the chart 100 and the information (FIG. 12) showing the relationship between the information on the thickness of the recording material S and the upper limit with respect to a difference between the plurality of test voltages and the transfer portion part voltages corresponding to the plurality of the test voltages. Then, from the extracted voltage, the transfer voltage is set on the basis of information on the density acquired from an associated test image 101. In this embodiment, of the extracted setting values, on the basis of the voltage value when the acquired density of the associated test image is maximum, the controller 30 sets the transfer voltage.

In this embodiment, the second detection result is a detection result of the detection means 76*a* and 76*b* acquired when the test images 101 are transferred onto the recording material S. Further, in this embodiment, the first detection result is a detection result of the detection means 76*a* and 76*b* acquired under application of the voltage with a positive absolute value when the recording material S is absent in the transfer portion N in a period from input of the instruction to output the chart 100 to the controller until the chart is outputted. During the operation in the mode described above, the controller 30 is capable of performing the process of notifying the operator of the information on the sent transfer voltage. Further, during the operation in the mode, the controller 30 is capable of receiving an instruction to charge the transfer voltage set by the controller 30. In addition, the information on the thickness may also be information on the thickness of the recording material S, the basis weight of the recording material S or the information on the kind of the recording material S based on the thickness or the basis weight.

As described above, according to this embodiment, in a constitution in which the operation in the adjustment mode such that the chart on which the patches are formed is outputted and then the setting of the secondary transfer voltage is adjusted is performed, it becomes possible to more appropriately adjust the setting of the secondary transfer voltage.

Embodiment 2

Next, another embodiment of the present invention will be described.

The basic structure and operation of the image forming apparatus of this embodiment are the same as those of the image forming apparatus of the embodiment 1. Therefore, as to the image forming apparatus of this embodiment, elements including the same or corresponding functions or structures as those of the image forming apparatus of the embodiment 1 are denoted by the same reference numerals or symbols as those of the embodiment 1, and detailed description thereof is omitted for simplicity.

In the embodiment 1, the acquiring means for acquiring the patch brightness information (density information) was the image reading portion 80 to which the chart discharged from the image forming apparatus 1 is supplied by the operator. On the other hand, in this embodiment, the acquiring means acquires the patch brightness information (density information) when the chart is discharged from the image forming apparatus 1.

FIG. 14 is a schematic cross-sectional view of the image forming apparatus 1 according to this embodiment. The image forming apparatus 1 of this embodiment includes an in-line image sensor 12 serving as a reading portion for reading the image on the recording material S is provided downstream of the fixing portion 46 in the feeding direction of the recording material S. In this embodiment, the structure is such that the image sensor 12 can read an image density of an image on the recording material S, particularly an image density (brightness) of the patch on the chart, at 1200 dpi (that is, it can convert optically acquired information into an electrical signal).

The operation in the adjustment mode in this embodiment is similar to the embodiment 1 except that instead of the supply of the chart to the image reading portion 80 after the chart is discharged from the image forming apparatus 1, the chart is read by the image sensor 12. The image sensor 12 may also be a spectroscopic sensor, and the image density may also be calculated from spectroscopic data of the image.

According to this embodiment, the same effects as those of the embodiment 1 can be provided, and the operation burden of the operator can be more reduced than the embodiment 1.

While the present invention has been described with reference to exemplary embodiments, it is to be understood that the invention is not limited to the disclosed exemplary embodiments. The scope of the following claims is to be accorded the broadest interpretation so as to encompass all such modifications. And equivalent structures and functions.

This application claims the benefit of Japanese Patent Application No. 2019-042075 filed on Mar. 7, 2019, which is hereby incorporated by reference herein in its entirety.

What is claimed is:

1. An image forming apparatus comprising:

an image bearing member configured to bear a toner image;

a transfer member configured to transfer the toner image from said image bearing member onto a recording material at a transfer nip under application of a voltage;

a voltage source configured to apply the voltage to said transfer member;

a sensor configured to detect a current value or a voltage value outputted from said voltage source when the voltage is applied from said voltage source to said transfer member;

an image detecting portion configured to detect information on a density of an image on the recording material; and a controller configured to execute an operation in a mode for setting a transfer voltage to be applied to said transfer member when the toner image is transferred onto the recording material;

wherein in the mode, the controller controls said voltage source so that a plurality of different transfer voltages are applied from said voltage source to said transfer member when a plurality of test images formed on the image bearing member are transferred to a test recording material to produce test chart, and wherein said controller sets the transfer voltage on the basis of a detection result of said image detecting portion when said image detecting portion detects images on the test chart, a first detection result of said sensor acquired under application of a voltage with a positive absolute value from said voltage source to said transfer member in a state that the recording material is absent in said transfer nip and a second detection result of said sensor acquired under application of test voltages from said voltage source to said transfer member in a state that the test recording material is present in said transfer nip during the operation in the mode.

2. An image forming apparatus according to claim 1, wherein during the operation in the mode, said controller sets the transfer voltage on the basis of information on a thickness of the test recording material.

3. An image forming apparatus according to claim 1, wherein the first detection result is a relationship between the voltage and the current acquired by said sensor under application of voltages of a plurality of levels from said voltage source to said transfer member when the recording material is absent in said transfer nip.

4. An image forming apparatus according to claim 3, wherein the relationship is a first relationship and said controller sets the transfer voltage on the basis of the first relationship and a second relationship between the voltage and the current acquired by said sensor under application of voltages of a plurality of levels from said voltage source to said transfer member when the test recording material is present in said transfer nip.

5. An image forming apparatus according to claim 4, wherein said controller sets the transfer voltage on the basis an information on a difference of the first relationship and the second relationship, a third relationship between information on a thickness of the recording material and an upper limit with respect to the difference, and the information on the thickness of the test recording material.

6. An image forming apparatus according to claim 1, wherein the second detection result is a detection result by said sensor acquired when the test images are transferred onto the recording material.

7. An image forming apparatus according to claim 1, wherein the first detection result is a detection result by said sensor acquired when the recording material is absent in said transfer nip in a period from input of an instruction to output the test chart to said controller until the test chart is outputted.

8. An image forming apparatus according to claim 1, wherein during the operation in the mode, said controller performs a process of notifying information on the transfer voltage set by said controller.

9. An image forming apparatus according to claim 1, wherein during the operation in the mode, said controller is capable of receiving an instruction to change the transfer voltage set by said controller.

10. An image forming apparatus according to claim 2, wherein the information on the thickness is information on the thickness of the recording material, a basis weight of the recording material or a kind of the recording material based on the thickness of the recording material or the basis weight of the recording material.

11. An image forming apparatus according to claim 1, wherein said image detecting portion detects a density of the test image on the test chart by being supplied with the test chart outputted from said image forming apparatus.

12. An image forming apparatus according to claim 1, wherein said image detecting portion detects a density of the test image on the test chart when the test chart is outputted from said image forming apparatus.

13. An image forming apparatus according to claim 1, wherein said image bearing member is an intermediary transfer member configured to feed the toner image, primary-transferred from another image bearing member, to the recording material for secondary transfer.

14. An image forming apparatus according to claim 1, wherein said transfer member contacts said image bearing member and forms said transfer-nip, where the recording material is nipped and fed, between itself and said image bearing member.

* * * * *